United States Patent [19]

Jung et al.

[11] Patent Number: 5,063,800

[45] Date of Patent: Nov. 12, 1991

[54] PIN TABLE

[75] Inventors: Rolf Jung, Waiolingen, Fed. Rep. of Germany; Jack M. Schwartzott, Norcross, Ga.; Robert J. Pieroni, Youngstown, N.Y.; Arnold Tobler, Upton, Mass.

[73] Assignee: Eastman Machine Company, Buffalo, N.Y.

[21] Appl. No.: 408,706

[22] Filed: Sep. 18, 1989

[51] Int. Cl.[5] ..... B26D 7/01; D06H 7/00

[52] U.S. Cl. ..... 83/14; 83/22; 83/169; 83/451; 83/939; 269/21; 269/54.5

[58] Field of Search ..... 269/54.5, 20, 21, 54.4, 269/54.3; 83/451, 938, 939, 936, 14, 169, 402, 177, 152, 100, 22

[56] References Cited

U.S. PATENT DOCUMENTS

| | | | |
|---|---|---|---|
| 3,695,134 | 10/1972 | Hardwick | 83/655 X |
| 3,838,618 | 10/1974 | Eissfeldt et al. | 83/936 X |
| 4,209,165 | 6/1980 | Hachisuka | 269/54.5 |
| 4,301,999 | 11/1981 | Higgens et al. | 269/21 |
| 4,312,501 | 1/1982 | Veith | 270/30 |
| 4,747,329 | 5/1988 | Lukens, Jr. | 83/648 X |
| 4,807,504 | 2/1989 | Vandermarliere | 83/169 X |
| 4,822,015 | 4/1989 | Glasman et al. | 269/54.5 X |
| 4,832,323 | 5/1989 | Principe et al. | 269/54.5 |
| 4,907,479 | 3/1990 | Nasu | 83/169 X |

*Primary Examiner*—Frank T. Yost
*Assistant Examiner*—Kenneth E. Peterson
*Attorney, Agent, or Firm*—Hodgson, Russ, Andrews, Woods & Goodyear

[57] ABSTRACT

A method and apparatus for supporting sheet material such as cloth during operations thereon such as cutting wherein a pattern is placed on a supporting surface provided with a plurality of pins extending through apertures in the surface, the pins are lowered below the surface for removal of the pattern whereupon sheet material is placed on the surface, typically a plurality of plies being layed up in a stack, and simultaneously the pins are moved through the sheet material to maintain alignment and matching of the plies in the stack. The pattern then is placed on the sheet material in a position determined by the location of the pins, and the material is shaped such as by cutting. A plurality of separate pin holding and supporting devices of narrow width are spaced lengthwise along the apparatus and independently movable lengthwise toward and away from each other. Pins of adjacent rows can be closely spaced together thereby achieving a grid pattern wherein the pins are relatively closely spaced. There is provided apparatus for developing a positive pressure which is employed to apply a flotation force to sheet material on the surface to facilitate movement of the material along the surface, apparatus for developing a negative pressure which is employed to apply a hold down force to sheet material on the surface to facilitate operating on the material, and apparatus for controlling selection of positive or negative pressure so developed.

25 Claims, 12 Drawing Sheets

Fig. 6.
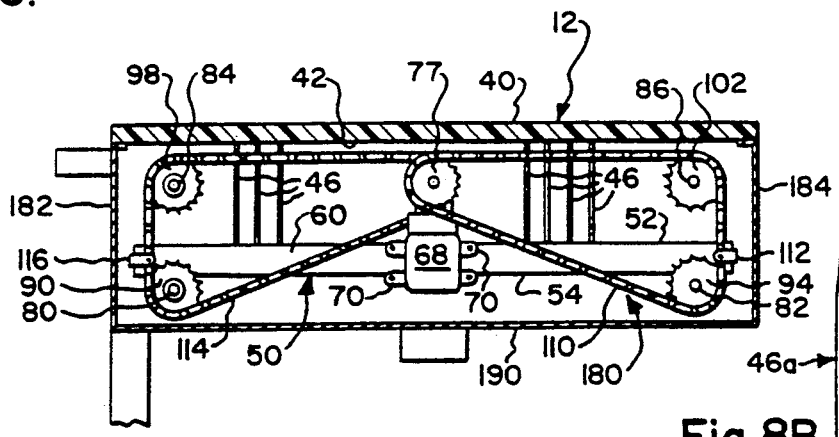
Fig. 8A.
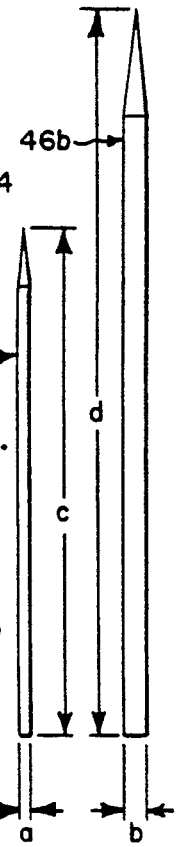
Fig. 8B.
Fig. 7.
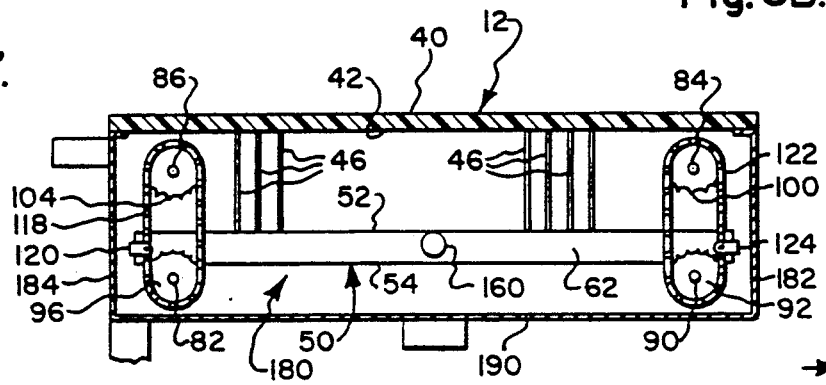
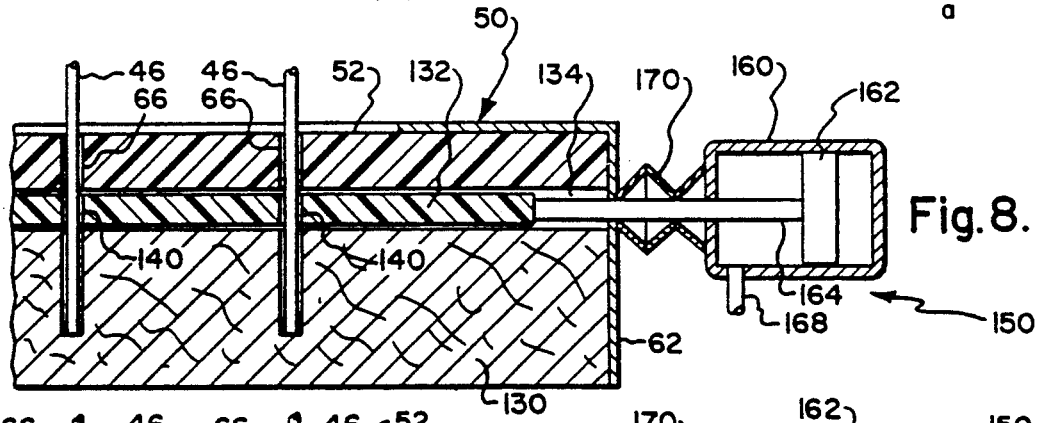
Fig. 8.
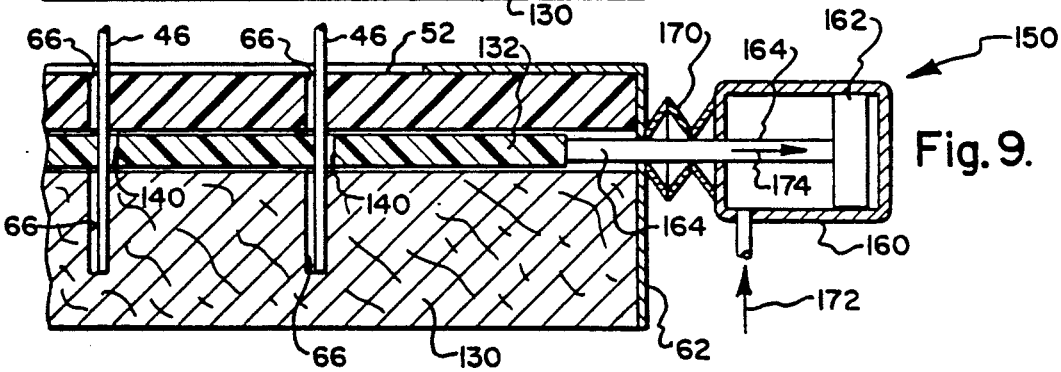
Fig. 9.

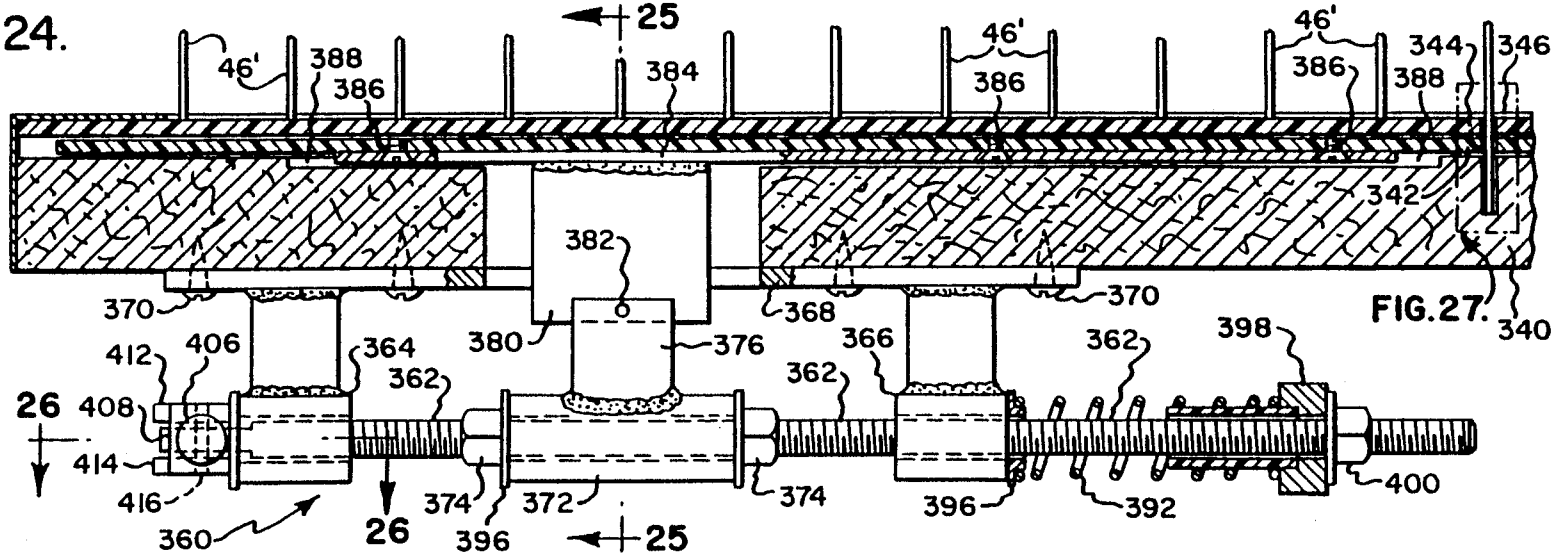
Fig. 24.
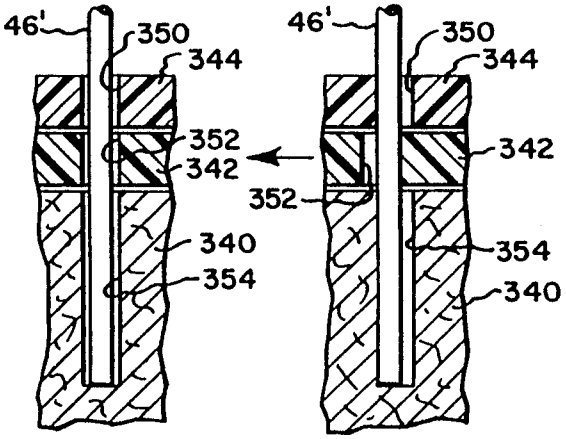
Fig. 28.
Fig. 27.
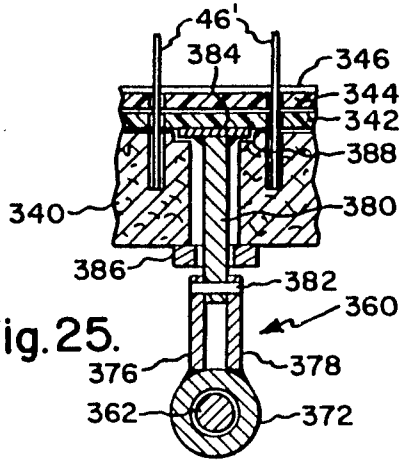
Fig. 25.
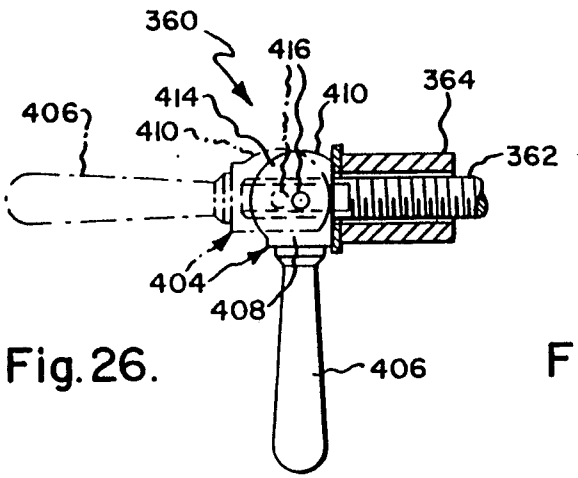
Fig. 26.

Fig. 38.
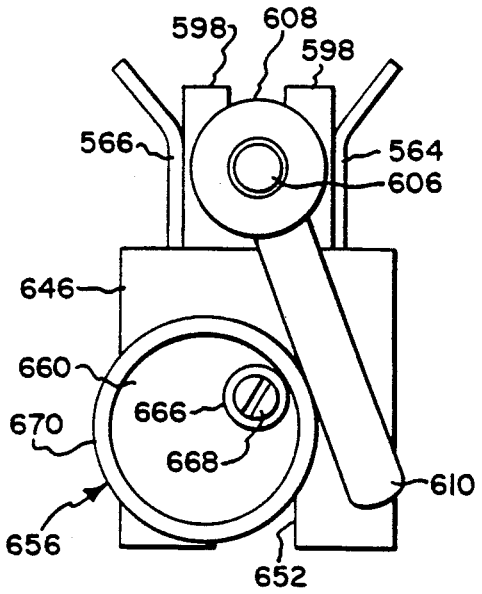
Fig. 39.
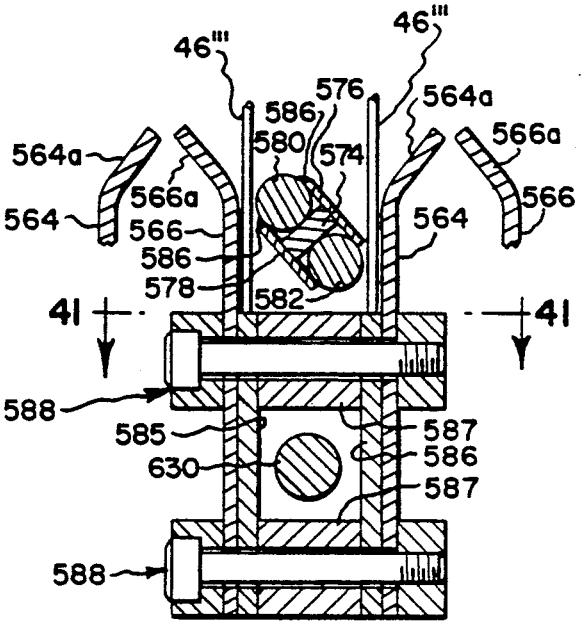
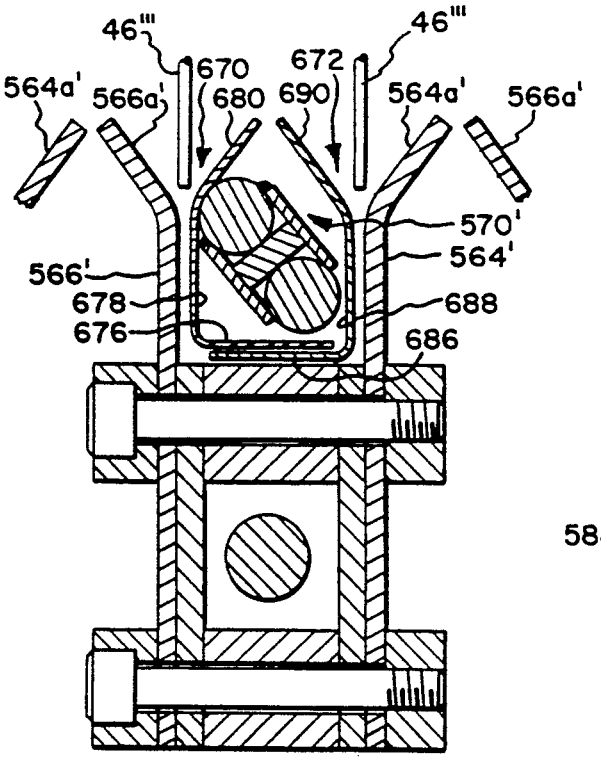
Fig. 42.
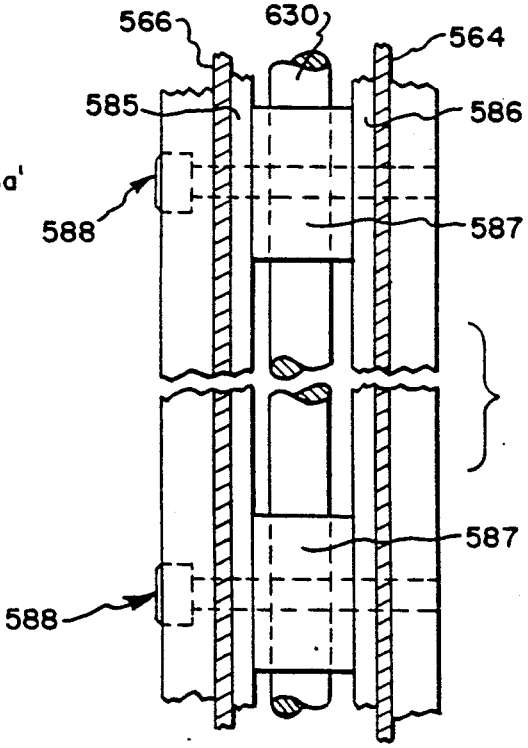
Fig. 41.

PIN TABLE

BACKGROUND OF THE INVENTION

This invention relates to the art of apparatus and methods in performing operations such as cutting sheet material like cloth, and more particularly to a new and improved pin table and associated method for supporting and matching patterned sheet material during such operations.

One area of use of the present invention is supporting and matching patterned sheet material in a stack for cutting a pattern from the stack, although the principles of the present invention can be variously applied. The matching of plaids, strips and checked fabrics has been an expensive and difficult manual process for apparel manufacturers with stringent quality matching requirements. Problems can occur because the panels making up a garment must be correctly matched, and the pattern of each panel must be in the correct position in order for the whole garment to match perfectly. Furthermore, distortion in the fabric sometime causes the size of the check or pattern to differ and stripes are not always straight. One proposed solution to the foregoing is known in the art as a pin table.

It would, therefore, be highly desirable to provide an improved method and apparatus for supporting and matching patterned sheet material during operations performed thereon, in particular for supporting and matching patterned cloth in a stack for cutting a pattern therefrom, resulting in labor and material savings and improved quality. It would be advantageous to provide the foregoing with the capability of holding the matched sheet material in a stack while being cut, as well as the capability of moving the stacked sheet material along the supporting surface. It would be desirable to provide the foregoing in a new and improved pin table, and wherein such pin table optimizes matching of the grid pattern of the pins to plaid pattern fabrics of any size plaid.

SUMMARY OF THE INVENTION

It is, therefore, a primary object of this invention to provide a new and improved apparatus and method for supporting and matching patterned sheet material during operations thereon such as cutting.

It is a further object of this invention to provide such an apparatus and method for supporting and matching patterned sheet material such as cloth in a stack for cutting a pattern from the stack.

It is a more particular object of this invention to provide the foregoing in a new and improved pin table.

It is a more particular object of this invention to provide such a pin table which optimizes matching of the grid pattern of the pins to plaid pattern fabrics of any size plaid.

It is a further object of this invention to provide such an apparatus and method which results in labor and material savings and improved quality.

It is a further object of this invention to provide such an apparatus and method having the capability of holding the matched sheet material in a stack while being cut as well as the capability of moving the stacked sheet material along the supporting surface.

It is a further object of the this invention to provide such a pin table which is economical to manufacture and effective and efficient in operation.

The present invention provides a method and apparatus for supporting sheet material such as cloth during operations thereon such as cutting wherein a pattern is placed on a supporting surface provided with a plurality of pins extending through apertures in the surface, the pins are lowered below the surface for removal of the pattern whereupon sheet material is placed on the surface, typically a plurality of plies being layed up in a stack, and simultaneously the pins are moved through the sheet material to maintain positioning thereof on the surface, i.e. to maintain alignment and matching of the plies in the stack. The pattern then is placed on the sheet material in a position determined by the location of the pins, and the material is shaped such as by cutting. The pins can be moved through the material to be at or below the surface and the sheet material can be held on the surface, such as by negative pressure applied through the apertures.

The apertures are arranged in closely-spaced relation in a grid-like pattern on the supporting surface, and the apparatus includes holding and supporting means for receiving the pins at the ends opposite the sharp heads thereof and holding the pins substantially perpendicular to the supporting surface and locating the heads in registry with the apertures. A plurality of separate pin holding and supporting means, each of relatively narrow width, are provided in spaced relation lengthwise along the apparatus and are independently movable lengthwise toward and away from each other. As a result, pins of adjacent rows can be closely spaced together thereby achieving a grid pattern wherein the pins are relatively closely spaced. This, in turn, optimizes matching the grid pattern of pins to fabric patterns. There is also provided means for moving the supporting means to move the pins through the apertures between a position where the heads of the pins are spaced below the supporting surface and a position where the pins extend through the apertures and the heads of the pins are above the supporting surface so that the sheet material can be anchored thereon.

In another aspect thereof, the present invention provides means for defining a pressure chamber in communciation with the apertures in the supporting surface, means for developing a positive pressure in the chamber which is communicated through the apertures when open to apply a flotation force to sheet material on the surface to facilitate movement of the material along the surface, means for developing a negative pressure in the chamber which is communicated through the apertures when open to apply a hold down force to sheet material on the surface to facilitate operating on the material, and control means for controlling selection of positive or negative pressure developed in the chamber. Alternatively, the chamber can be replaced with manifold means connected to a source of positive pressure, a plurality of openings in the supporting surface, fluid sealing means for sealing the apertures while allowing pins to be moved therethrough, and means for connecting the manifold means to the openings to supply positive pressure to the openings for applying a flotation force to sheet material on the surface.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 1 is a plan view of the apparatus of the present invention with an individual section separated therefrom for puposes of illustration;

FIG. 1*a* is an enlarged plan view of a portion of the supporting surface in the apparatus of FIG. 1;

FIG. 6 is a sectional view taken about on line 6—6 in FIG. 4;

FIG. 7 is a sectional view taken about on line 7—7 in FIG. 4;

FIG. 8 is a sectional view taken about on line 8—8 in FIG. 4 and illustrating one position of the pin holding means;

FIGS. 8A and 8B are side elevational views of two sizes of pins used in the method and apparatus of the present invention;

FIG. 9 is a sectional view similar to FIG. 8 and illustrating another position of the pin holding means;

FIG. 24 is an enlarged sectional view taken about on line 24—24 in FIG. 22;

FIG. 25 is a sectional view taken about on line 25—25 in FIG. 24;

FIG. 26 is a sectional view taken about on line 26—26 in FIG. 24;

FIG. 27 is an enlarged sectional view taken in the field of view indicated in FIG. 24 and illustrating one position of the pin holding means;

FIG. 28 is a view similar to FIG. 27 and illustrating another position of the pin holding means;

FIG. 38 is an end elevational view taken about on lines 38—38 in FIG. 37;

FIG. 39 is a fragmentary sectional view taken about on line 39—39 in FIG. 37;

FIG. 41 is a fragmentary sectional view with parts removed taken about on line 41—41 in FIG. 39;

FIG. 42 is a view similar to FIG. 39 illustrating an alternative arrangement of pin contacting means.

DETAILED DESCRIPTION OF THE ILLUSTRATED EMBODIMENTS

Figures 1, 1A, 2:
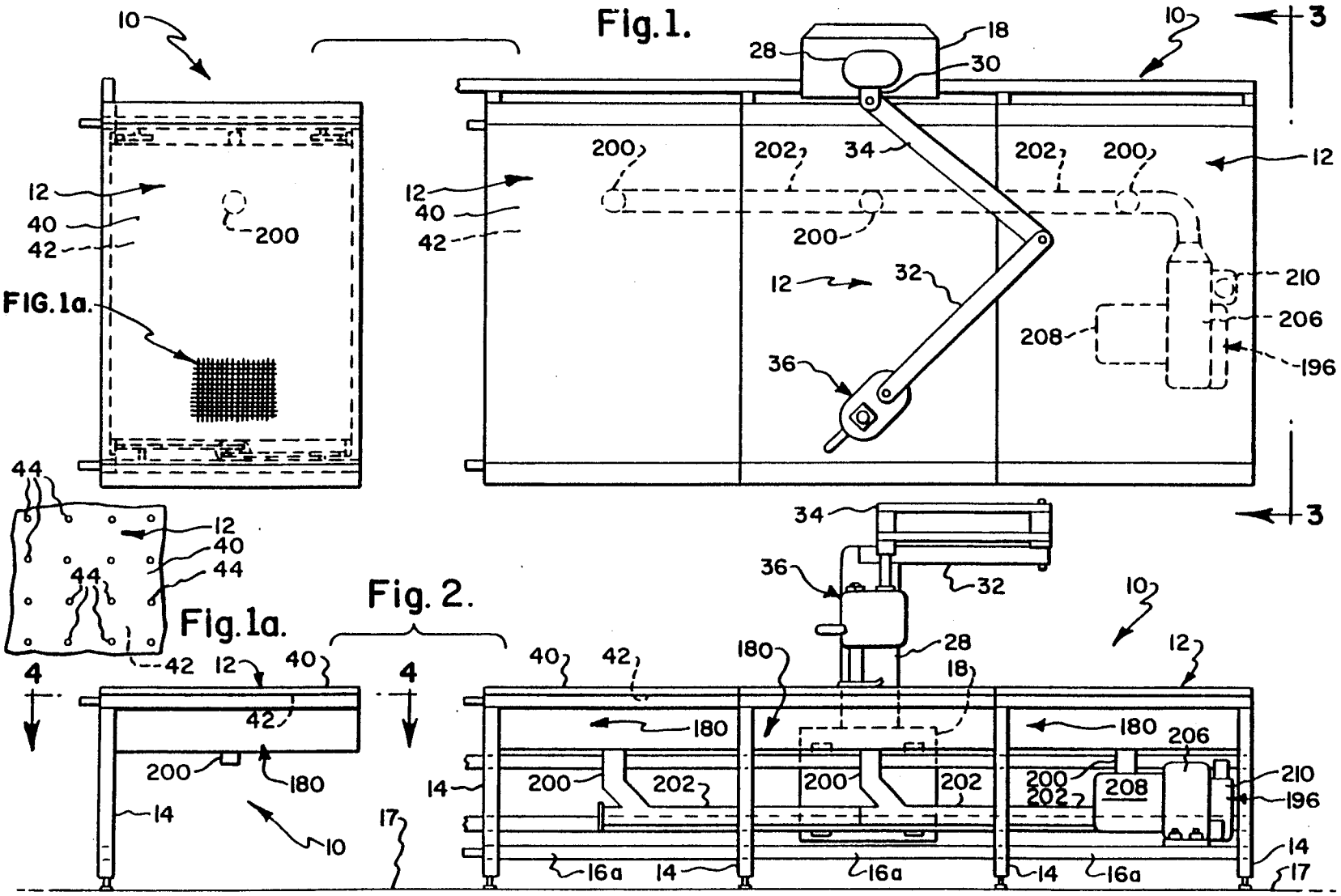
FIG. 2 is a side elevational view of the apparatus of FIG. 1.
Figure 3:
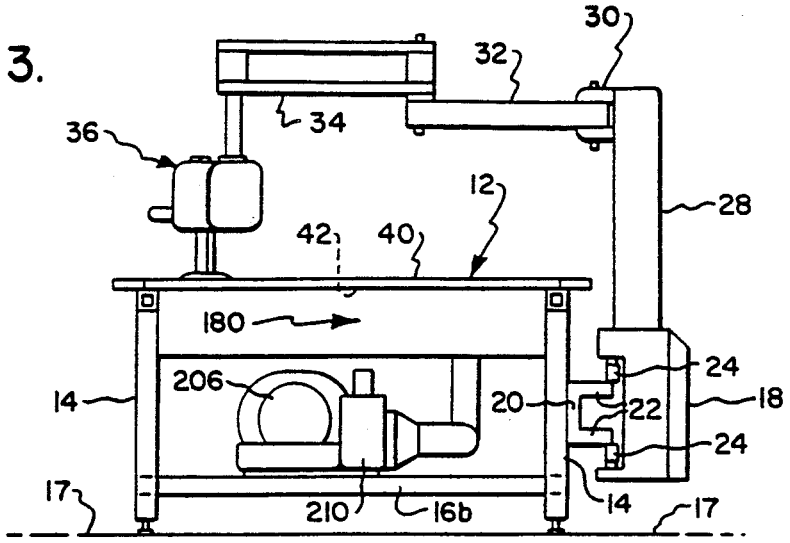
FIG. 3 is an end elevational view taken about on lines 3—3 in FIG. 1.

Referring now to FIGS. 1–3, the apparatus of the present invention includes a table generally designated 10 comprising a supporting frame and means on the frame defining a planar supporting surface 12 adapted to receive sheet material, such as cloth, placed thereon. The table 10 of the present illustration comprises a plurality of sections joined end-to-end to provide an elongated table of desired length. For purposes of illustration, one individual table section is shown by itself to the left in FIGS. 1 and 2. Table 10 comprises frame members including a plurality of upstanding legs 14 at spaced locations therealong joined by horizontal legs, for example leg 16*a* whereby the table 10 is supported on a suitable surface such as a floor 17 as shown in FIG. 2. The foregoing arrangement of horizontal and vertical legs is provided on both sides of table 10 and horizontal legs 16*b* are on the ends of the table 10.

Operatively associated with table 10 is shaping apparatus which in the present illustration is in the form of a cutting machine. In particular, the machine includes a lower portion or carriage 18 movably carried by rails extending along the side of the table frame. As shown in FIG. 3, a central web portion 20 is joined to the table frame and extends along the portion of table 10 along which movement of the cutting apparatus is desired. A pair of spaced apart, parallel rails or flanges 22 extend outwardly from web 20 at right angles thereto. Rails 22 guidably and supportedly receive wheels or rollers 24 of the carriage 18. A post 28 extends upwardly from carriage 18 and includes a bracket 30 to which is connected one end of a support arm arrangement. In particular, the support arm arrangement is disposed in a plane substantially parallel to the table surface 12 and includes a first section 32 pivotally connected at one end to bracket 30 and pivotally connected at the other end to one end of a second section 34, the outer end of which carries cutting apparatus in the form of a straight knife machine 36. The foregoing illustrative arrangement of carriage, support arm and straight knife machine is well known to those skilled in the art so that a detailed description is unnecessary. By way of further example, an illustrative arrangement is commercially available from Eastman Automated Systems, Inc. under the registered trademark EASI Auto-Arm Cutter.

The means 12 defining a planar supporting surface is in the form of a sheet of rigid material supported in the frame and disposed substantially parallel to the floor 17 or similar supporting surface on which the table 10 rests. Sheet 12 has an outer surface portion 40 for contacting the sheet material placed thereon and an oppositely disposed inner surface portion 42. As shown in FIG. 1*a*, sheet 12 is provided with a plurality of through apertures or bores 44 which are arranged in closely spaced relation and in a grid-like pattern. The apertures 44 are for the purpose of receiving and guiding pins such as the pins designated 46*a* and 46*b* in FIG. 8A, which pins are employed for matching of patterns in respective sheets of material and in relation to the pattern for shaping or cutting in a manner which will be described presently. In the illustrated arrangement wherein table 10 includes sections joined end-to-end, sheet 12 is in the form of corresponding sections.

Figure 4:
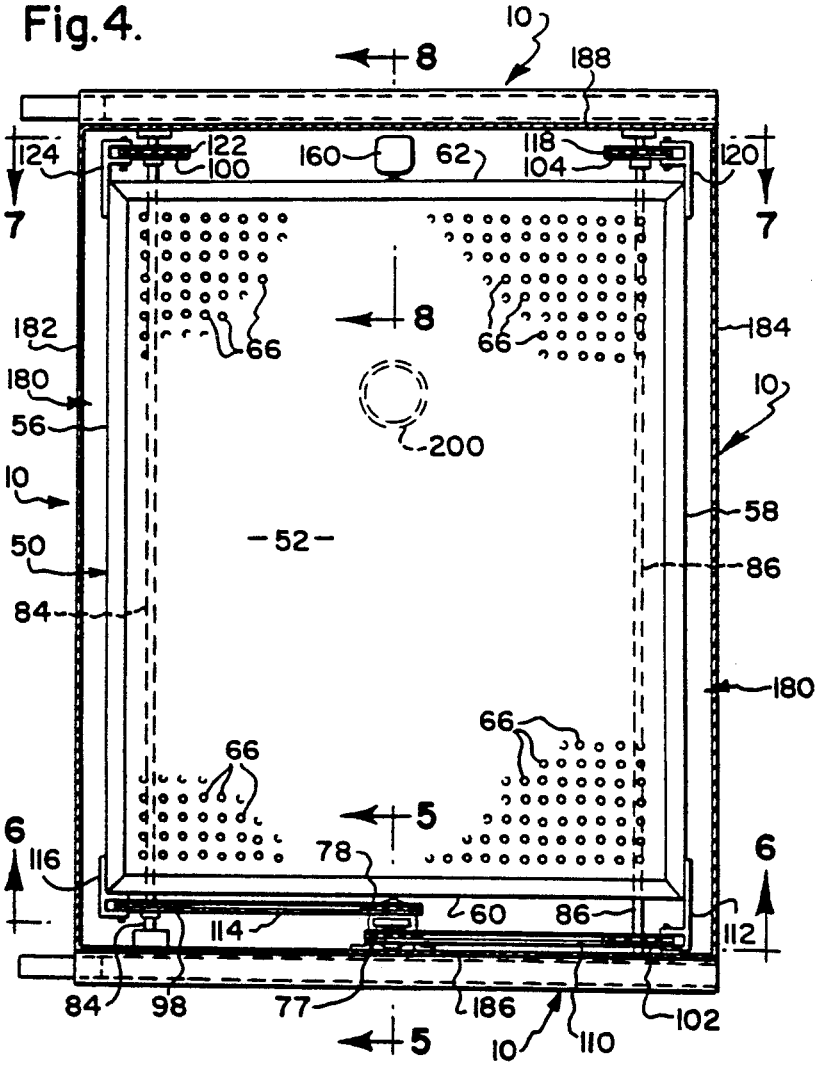
FIG. 4 is a sectional view taken about on line 4—4 in FIG. 2.

Referring now to FIGS. 4–7, the apparatus of the present invention further comprises means 50 carried by the frame for supporting the afore-mentioned pins 46. Each of the pins 46 has a sharp head at one end and an opposite end, and the supporting means 50 receives the pins at the opposite ends. The supporting means 50 maintains the disposition of the pins 46 substantially perpendicular to the plane of sheet 12 and maintains the location of the pins in registry with the apertures 44. One illustrative form of supporting means 50 is as shown in FIGS. 6 and 7 and comprises a housing which is in the form of a solid rectangular panel having first and second major planar surfaces 52 and 54, respectively, the first surface 52 being disposed toward sheet 12 and the second surface 54 being disposed in an opposite direction. The panel is bounded by opposite side surfaces or walls 56 and 58 joined by end surfaces or walls 60 and 62 as shown in FIG. 4. Housing 50 is provided with a plurality of recesses or apertures 66 extending inwardly from surface 52 and terminating within housing 50 thereby providing a stop or resting surface for the corresponding pins received therein. Each bore or recess 66 is of a cross sectional area slightly larger than the cross sectional area of the corresponding pin so that the pin fits in the recess somewhat freely or loosely for a purpose to be described. The recesses 66 are arranged in closely spaced relation in a grid-like pattern and in registry with the apertures 44. As a result, pins 46 are supported in panel 50 and when panel 50 is moved toward and away from sheet 12, pins 46 are moved into and out of the apertures 44 in sheet 12. In the illustrated arrangement wherein table 10 includes sections joined end-to-end, there is a pin supporting means 50 in each section.

Figure 5:
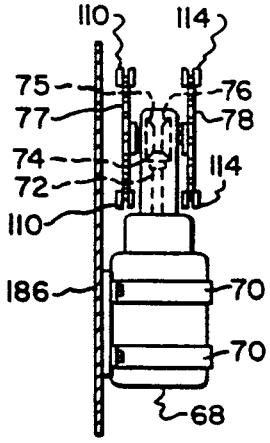
FIG. 5 is a sectional view taken about on line 5—5 in FIG. 4.

The apparatus of the present invention further comprises means for moving the supporting means 50 to move the pins 46 carried thereby through the apertures 44 in sheet 12 between position where the heads of the pins are spaced from the inner surface 42 so that the apertures are open and a position where the pins extend through the apertures 44 and the heads of the pins are spaced from the outer surface 40 so that sheet material can be anchored on the pins. An illustrative form of means for moving the supporting means 50 comprises drive means on the table frame, driven means supported by the frame and connected to the supporting means for moving the same when driven, and coupling means operatively connected to the drive means and the driven means. Furthermore, in the illustrated arrangement where table 10 includes sections joined end-to-end, there is a means for moving the pin supporting means 50 in each section. In particular, as shown in FIGS. 4–6, a drive motor 68 is mounted to the frame by a pair of brackets 70. The output shaft 72 of motor 68 drives a first helical gear 74 which meshes with a pair of helical gears 75 and 76 at right angles to the first gear and which are fixed to corresponding sprockets 77 and 78, respectively.

A first pair of shafts 80 and 82 are rotatably connected at opposite ends to the frame and extend substantially parallel to the axis of rotation of sprockets 77 and 78. Shafts 80 and 82 are located near surface 54 of supporting means 50 when spaced furthest from sheet 12 as shown in FIGS. 6 and 7. A second pair of shafts 84 and 86 are rotatably connected at opposite ends to the frame and extend substantially parallel to shafts 80 and 82 and are in general registry therewith. Shafts 84,86 are located between surface 52 of supporting means 50 and sheet 12. Sprockets 90 and 92 are fixed to shaft 80 near the ends thereof, sprockets 94 and 96 are fixed similarly to shaft 82, sprockets 98 and 100 are fixed similarly to shaft 84, and sprockets 102 and 104 are fixed similarly to shaft 86. The sprockets are located between the periphery of supporting means 50 and the apparatus frame. The coupling means comprises an arrangement of a plurality of endless belts trained around various sprockets and in the form of roller chains or the equivalent. In particular, a first belt 110 is trained around sprocket 77 and sprockets 94 and 102 and is fastened to panel 50 by a bracket 112. A second belt 114 is trained around sprocket 78 and sprockets 90 and 98 and is fastened to panel 50 by a bracket 116. A third belt 118 is trained around sprockets 96 and 104 and is fastened to panel 50 by a bracket 120. A fourth belt 122 is trained around sprockets 92 and 100 and is fastened to panel 50 by a bracket 124. By virtue of the foregoing arrangement, with the belts fastened to panel 50 and guided on the sprockets, the panel 50 is moved toward and away from sheet 12 depending upon the direction of rotation of motor shaft 72.

The apparatus of the present invention further comprises means on the supporting means 50 for releasably holding the pins 46. An illustrative form of releasable pin holding means comprises first means in pin supporting means 50 operatively associated with pins 46 and second means operatively connected to the first means for moving the first means between a position where pins 46 may be removed from supporting means, and a position where pins 46 are held firmly in supporting means 50. In the illustrated arrangement where table 10 includes sections joined end-to-end, there is a releasable pin holding means in each section. In particular, supporting means 50 includes a body 130 having a longitudinal axis disposed substantially parallel to the planes of surfaces 40,42 and substantially perpendicular to each of the recesses 66. Within the body 130 of supporting means 50 is a member 132 in the form of a plate slidably movable within an open region 134 defined in body 130. Plate 132 is movable in a direction substantially parallel to the longitudinal axis of body 130 and in a manner intersecting the axes of the apertures or recesses 66. Plate 132 has a plurality of through apertures or bores 140 therein and are arranged to be in registry with the recesses 66. Each of the apertures 140 has a cross sectional area substantially equal to the cross sectional areas of the corresponding recess 66 and in registry therewith.

There is also provided means generally designated 150 for moving member 132 from a first position illustrated in FIG. 8 where apertures 140 are in registry with recesses 66 so that pins 46 are loosely received in the recesses permitting them to be withdrawn to a second position illustrated in FIG. 9 where apertures 140 are slightly out of registry with recesses 66 in a manner holding the pins tightly within the supporting means 50 during use. The means for moving the body 132 comprises a piston and cylinder arrangement pneumatically or hydraulically operated. In particular, a cylinder 160 contains a piston 162 connected to one end of a rod 164 which extends outwardly from cylinder 162 and is connected to member 132. Operating fluid is supplied to cylinder 162 by a conduit 168. A flexible bellows 170 joins cylinder 160 to the supporting means 50. Movement of member 132 to the position of FIG. 9 wherein pins 46 are held tightly in place is effected by introducing fluid under pressure as indicated by arrow 172 in FIG. 9 to move piston 162 and thus member 132 to the right in the direction of arrow 174 in FIG. 9.

The apparatus of the present invention further comprises means on the frame 10 for defining a pressure chamber generally designated 180 in FIGS. 2, 3, 6 and 7 which chamber is exposed to portion 42 of supporting surface 12 so that the apertures 44 in surface 12 are in communication with the chamber 180. Furthermore, each section of table 10 has such a pressure chamber therewith. In particular, each chamber 180 is defined by side walls 182,184 and end walls 186, 188 all depending from sheet 12 and joined by a bottom wall was which completes a sealed chamber having an interior 192. As shown in FIGS. 4, 6 and 7, the pin supporting means 50 and the means for moving the same are located in chamber 180. This is provided for each section of the table 180. There is also provided means generally designated 196 operatively connected to the chamber 180 for changing the pressure therein. In particular, each chamber has branch conduit means 200 extending from the interior thereof, i.e. from the bottom wall 190, to a main conduit means 202 leading from each branch conduit to the output of the pressure changing means 196. The pressure changing means 196 comprises a compressor 206 driven by a motor 208 and controlled by a gate valve 210. Depending upon the position of valve 210, the pressure changing means 196 supplies either positive or negative pressure to each chamber 180. Positive pressure in chamber 180 is communicated through open apertures 44 to the sheet material, typically in a stack, on surface 12 to provide a flotation force to facilitate movement of the material along surface 12. Negative pressure or vacuum in chamber 180 is communicated through open apertures 44 to the sheet material, typically in a stack, on surface 12 to provide a force which enhances holding down of the sheet material on surface 12. By way of example, in an illustrative apparatus, compressor 206 is commercially available under the designation Gast Model R6335A, motor 208 is commercially available under the designation Bailor one half horsepower and Valve 210 is a two inch gate valve.

Figure 10:
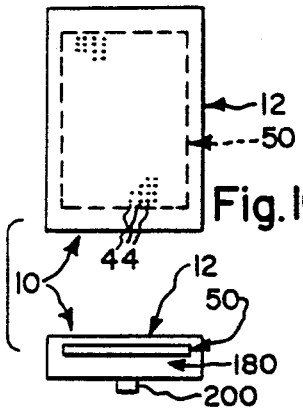
FIGS. 10–21 are diagrammatic views illustrating steps performed during the method according to the present invention.
Figure 11:
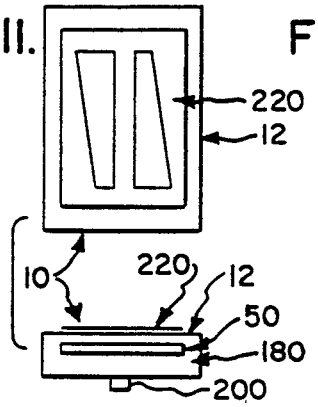
Figure 12:
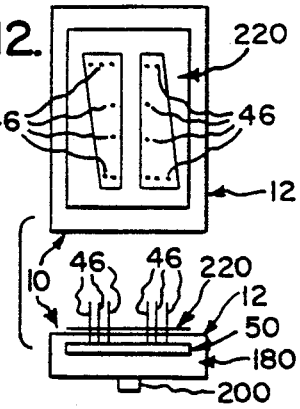
Figure 13:
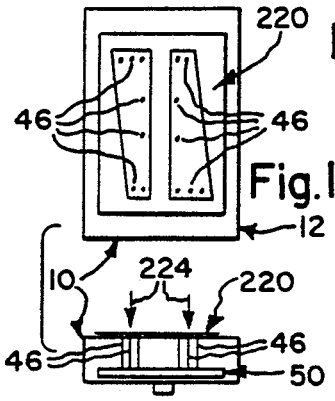
Figure 14:
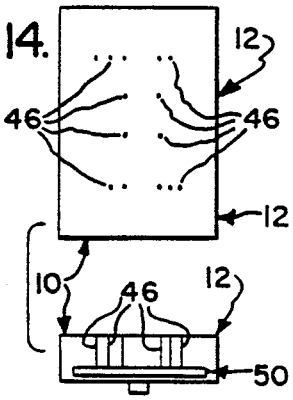

FIGS. 10–21 illustrates steps during the method of the present invention for supporting and shaping sheet material such as cloth. Thus, there is shown in FIG. 10 a section of table 10 provided with supporting surface 12 having apertures 44 therein with pin supporting means 50 below surface 12 and located within chamber 180 having pressure supply conduit 200. In carrying out the method, a pattern 220 is placed on surface 12 as shown in FIG. 11. For example, when cutting operations are to be performed on the sheet material, pattern 220 provides the outline around which the pieces or part are to be cut. The next step is illustrated in FIG. 12 and comprises inserting pins 46 into apertures 44, the number and arrangement with pins 46 being determined by the pattern. The pins are inserted manually through the pattern 220 as shown in FIG. 12, the blunt ends being received in the recesses 66 of supporting means as previously described and the sharp ends or heads of the pins are located outwardly of, i.e. above, surface 12. The pins are maintained in this arrangement during subsequent steps in the method. Next, the pins 46 are moved in the direction of arrows 224 in FIG. 13 by moving the supporting means 50 within the chamber 180 as shown. During such movement the pins 46 are maintained in the arrangement. Such movement of pins 46 places the sharp ends thereof at or below surface 12 whereupon pattern 220 is removed as shown in FIG. 14.

Figure 15:
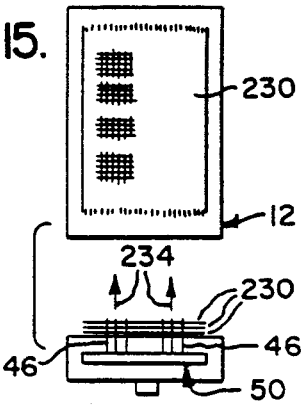
Figure 16:
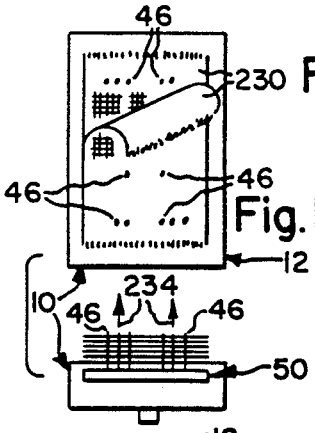
Figure 17:
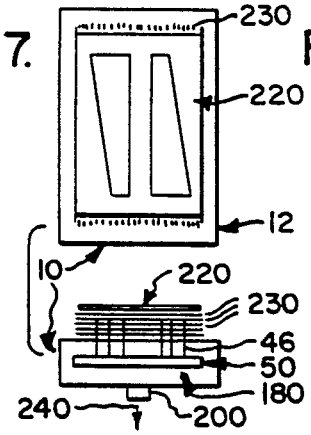

As shown in FIG. 15, the next step in the method of the present invention is placing sheet material 230 on surface 12 while moving pins 46 through sheet material 230 to maintain positioning of the sheet material 230 on surface 12. Pins 46 are moved in the direction of arrows 234 in FIG. 15, i.e. upwardly relative to surface 12. Typically the step comprises laying up a plurality of plies of sheet material on the surface 12 to provide a stack as illustrated in FIGS. 15 and 16 while moving pins 46 through the stack in the direction of arrows 234 to maintain alignment and matching of the plies in the stack. Upon completion of placing sheet material 230 on the surface 12, pattern 220 is placed on the sheet material as shown in FIG. 17 in a position determined by the location of pins 36, i.e. the pattern is placed on the exposed sharp ends or heads of pins 46.

Figure 18:
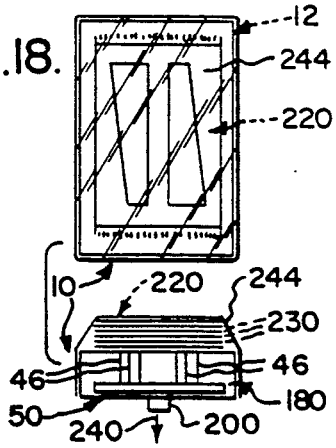
Figure 19:
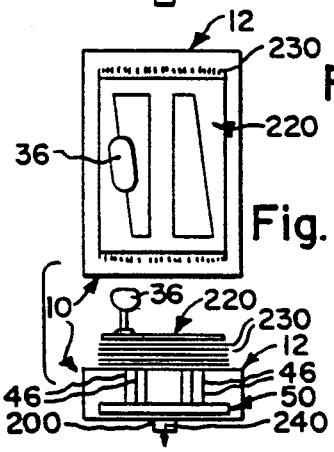
Figure 20:
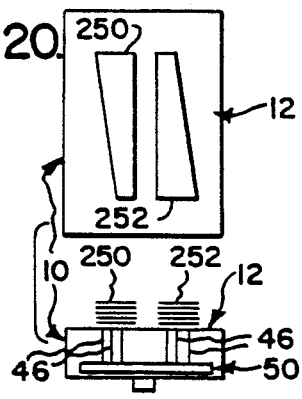
Figure 21:
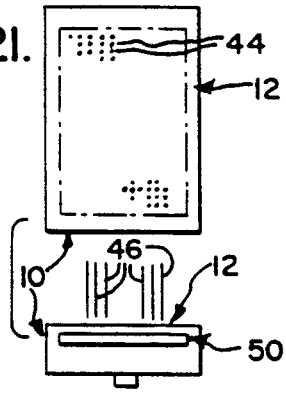

If desired, a shaping operation such as cutting can be performed with pins 46 remaining in the stack of sheet material, the cutting being guided by the pattern 220. Typically, pins 46 are moved through the sheet material 230 as shown in FIGS. 17 and 18 to locate the pin heads at or below surface 12. Holding of the stack on surface 12 is facilitated by applying negative pressure to chamber 180 by withdrawal of air therefrom indicated by arrow 240 due to operation of compression 206 under control of valve 210. The negative pressure is applied through apertures 44 to the sheet material to create a hold down force thereon. This can be enhanced by placing a thin clear sheet 244 of air impervious material such as Mylar on the stack. Next, the sheet material is shaped, for example cut by machine 36, by following the pattern 220. Cutting is done through the overlay sheet 244. This results in stacks of cut parts of pieces designated 250,252 in FIG. 19 which can be removed from surface 12. Such removal can be enhanced by applying a positive pressure to the interior of chamber 180 which is communicated through apertures 44 to the stacks to apply a flotation force thereon. Upon conclusion of the foregoing, the pins are moved upwardly through the apertures 46 and then withdrawn therefrom by hand as illustrated in FIG. 21 to prepare the table 10 for the next operation.

Figures 22, 23:
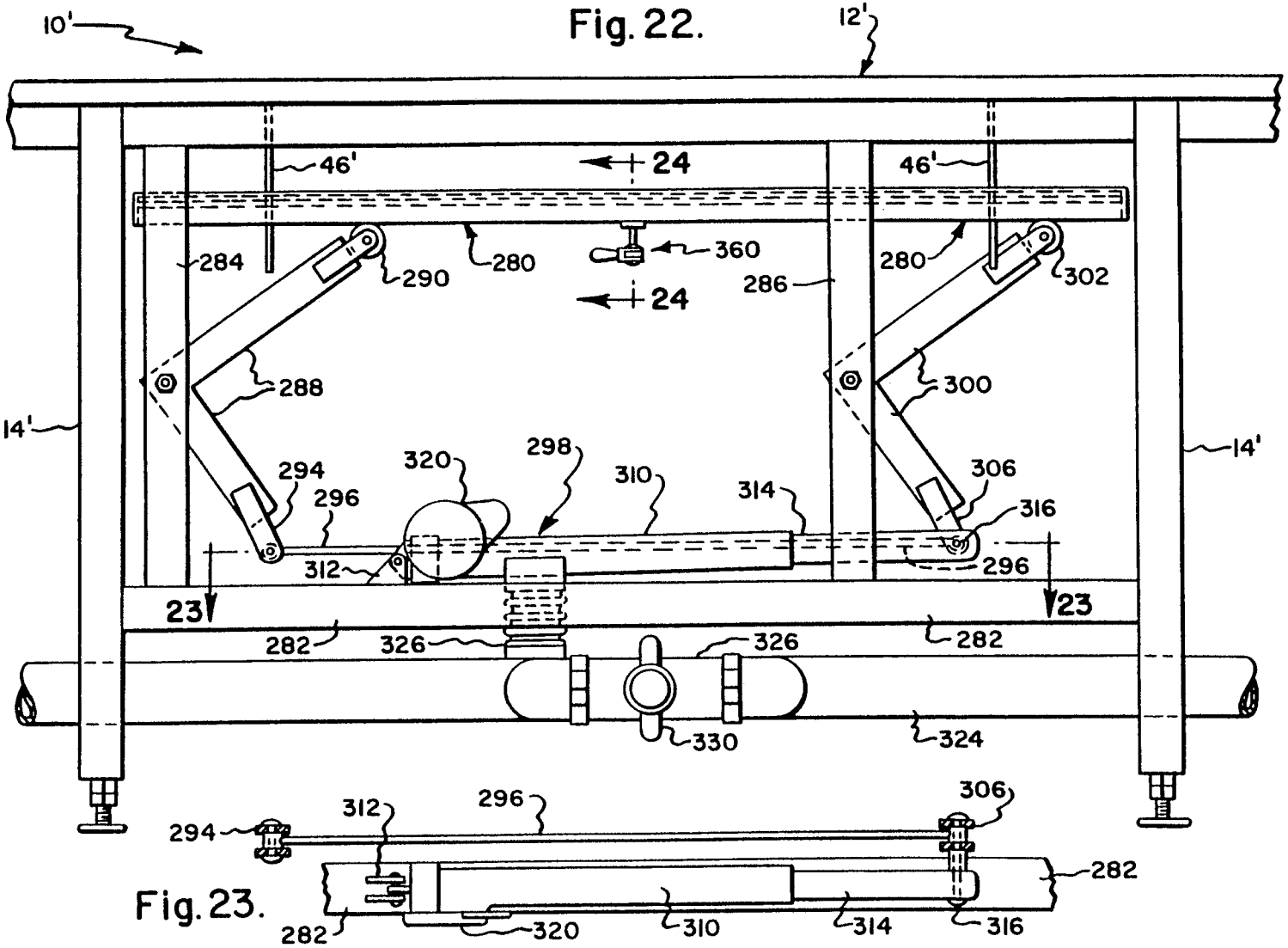
FIG. 22 is a side elevational view of apparatus according to another embodiment of the present invention.
FIG. 23 is a sectional view taken about on line 23—23 in FIG. 22.

FIGS. 22–28 illustrate another form of pin supporting and holding means. For convenience in illustration, components of this embodiment identical to those of the previous embodiment will be identified by the same reference numeral provided with a prime designation. As in the previous embodiment, table 10' typically comprises a plurality of sections and one of those sections is shown in FIG. 22. Table top 12' is supported by a plurality of vertical supporting legs 14'. A pin holding and supporting means generally designated 280 is in the form of a rectangular housing similar to supporting means 50 of the previous embodiment. For convenience in illustration, two pins 46' are shown extending upwardly from the holding and supporting means 280 which will be described in detail presently. There is provided an arrangement for raising and lowering the holding and supporting means 280 so that pins 46' can be moved in directions toward and away from table top 12' as in the previous embodiment. A horizontal supporting frame 282 is fixed at opposite ends to legs 14' and a pair of spaced apart vertical supporting frame members 284 and 286 are fixed at the upper ends thereof to table top 12' and are fixed at the lower ends thereof to horizontal frame member 282. A first L-shaped link member 288 is provided with a roller 290 connected to one end thereof and contacting the lower surface of housing 280. The junction of the arms of link 288 is pivotally connected to vertical frame member 284 and the other end is pivotally connected by a bracket 294 to one end of the rod 296 of a linear actuator assembly 298. A second L-shaped link member 300 similarly is provided with a roller 302 connected to one end thereof in contacting the lower surface of housing 280. The junction of the arms of link 300 are pivotally connected to the other vertical frame member 286 and the other end thereof is pivotally connected by a bracket 306 to rod 296. As shown in FIG. 23 linear actuator assembly 298 comprises an hydraulic cylinder 310 connected at one end by a bracket 312 to horizontal frame member 282 and includes a piston rod 314 extending from cylinder 310 and pivotally connected at the outer end by pin 316 to bracket 306 and therefore to rod 294. A housing 320 contains adjustable microswitches for controlling the linear actuator.

Extension of piston rod 314 during operation of cylinder 310 pivots link members 288 and 300 in a counterclockwise direction thereby raising the housing 280 to move pins 46' upwardly through tabletop 12' whereas retraction of piston rod 314 during operation of cylinder rod 310 pivots links 288,300 in a clockwise direction thereby lowering housing 280 to lower pins 46'. As in the previous embodiment, housing 280 and the raising and lowering arrangement therefor are contained within a pressure chamber having side, end and bottom walls (not shown) there being a pressure chamber for each of the table sections. A conduit 324 extends along the entire length of the combination of table sections, and branch conduits, for example the one designated 326 in FIG. 22, connect the main conduit 324 to the individual pressure chambers for supplying positive or negative pressure thereto under control of valves such as that designated 330 in FIG. 22.

The pin holding and supporting means 280 of this embodiment is similar to the arrangement shown in FIGS. 8 and 9 in that it comprises apertured plate-like members relatively slidable to vary the effective size of the apertures between pin clamping and pin releasing conditions. As shown in FIG. 24, the holding and supporting means 280 comprises a first rectangular plate 340 of substantial thickness and having width and length dimensions substantially equal to those of the overall pin holding and supporting means 280, and a pair of second and third plates 342 and 344, respectively, each having substantially the same length and width as that of plate 40 but being of considerably smaller thickness. A thin sheet or cover layer 346 is provided on the outer or top surface of plate 344 as viewed in FIG. 24. The middle plate 342 is slidable along the space between top plate 344 and bottom plate 340, this being facilitated by the slightly shorter length at plate 342. Top plate 344 is provided with a plurality of through apertures 350 shown in FIG. 27 in closely spaced relation and arranged in a grid pattern similar to that shown in FIGS. 1A and 4. Corresponding apertures are provided in cover sheet 346 in registry with aperture 350. The middle plate 342 likewise is provided with a plurality of through bores or apertures 352 in closely spaced relation and arranged in a grid pattern. Furthermore, the apertures are arranged so that apertures 352 and 350 of plates 342 and 344, respectively, are registerable when plate 342 is moved to a certain position. Apertures 350 and 352 are of slightly larger diameter as compared to the diameter of pins 46'. Bottom plate 340 is provided with a plurality of recesses or apertures 354 extending inwardly from the top surface of plate 340 and terminating within plate 340 thereby providing a stop or resting surface for corresponding pins received therein. Each bore or recess 354 has a cross sectional area or diameter slightly larger than the cross sectional area or diameter of pins 46' so that each pin fits in recess 354 somewhat freely or loosely. Recesses 354 are arranged in closely spaced relation in a grid-like pattern and in fixed juxtaposition in registry with apertures 350 of top plate 344.

The pin holding and supporting means further comprises manually operated means generally designated 360 operatively connected to bottom plate 340 and to the intermediate plate 342 for moving plate 342 between a first position illustrated in FIG. 27 wherein apertures 352 of plate 342 are substantially in registry with recesses 354 of plate 340 and apertures 350 of plate 342, and a second position illustrated in FIG. 28 wherein apertures 352 of plate 342 are out of registry with recess 354 and apertures 350. In the first position pins 46' are loosely held as shown in FIG. 27, and in the second position pins 46' are clamped or tightly held in the pin supporting and holding means as shown in FIG. 28. The manually operated means 360 includes a rod 362 axially movably mounted in spaced relation to plate 340 and disposed with the longitudinal axis thereof parallel to the direction of sliding movement of plate 342. Rod 362 is axially movably held in a pair of spaced apart brackets 364 and 366 fixed such as by welding to a bar 368 which is fastened such as by screws 370 to the outer or lower surface of plate 340. Rod 362 is threaded and a sleeve-like coupler 372 is fixed on rod 362 by a pair of nuts 374 threaded on rod 362 and bearing against opposite ends of coupler 372. Coupler 372 is located between the ends of rod 362 and between brackets 364,366 as shown in FIG. 24. Coupler 372 is fixed to plate 342 by the following illustrative arrangement. A pair of relatively small rectangular plates 376,378 are fixed such as by welding at the ends thereof at a pair of closely spaced locations along the circumference of coupler sleeve 372 as shown in FIG. 25, the plates 376,378 being in spaced apart, parallel relation disposed in planes parallel to the longitudinal axis of rod 362 and to the direction of movement of plate 342. A second, relatively larger rectangular plate 380 is fitted at one end between plates 376,378, being mounted therein by a pin 382. Plate 380 is disposed in a plane parallel to plates 376,378 and is fixed such as by welding at the opposite end to a strip 384 disposed parallel to the longitudinal axis of rod 362 and fastened such as by screws 386 to the lower surface of plate 342. A narrow channel 388 is formed in the upper surface of plate 340 to accommodate strip 384.

The manually operated means further comprises means for applying a biasing force to rod 362 to maintain the arrangement in either of the first or second conditions. In the illustrative arrangement shown, a coil spring 392 is positioned on the end of rod 362 extending axially outwardly from bracket 366. One end of spring 396 bears against bracket 366, being stabilized by a spring retainer 396 loosely fitted on rod 362. The opposite end of spring 392 bears against a spring retainer 398 fixed on rod 362 by means of a nut 400. The opposite end of rod 362 as viewed in FIG. 324 is operatively engaged by a handle 404 pivotally mounted to bracket 364. In particular, handle 404 includes a grip 406 extending from a handle body 408 which includes a camming surface 410. A pair of spaced apart parallel plates 412,414 are fixed such as by welding to the outer end of bracket 364 and are disposed in planes parallel to the longitudinal axis of rod 362. Handle body 408 is positioned within plates 412,414 and pivotally mounted therein by pin 416. Camming surface 410 contacts the end of rod 362 extending through bracket 364.

When handle 404 is in the solid line position illustrated in FIG. 26 camming surface 410 urges rod 362 to the right-most position as viewed in FIG. 24 placing intermediate plate 342 in the position of FIG. 27 wherein pins 46 are releasably held or supported in the holding and supporting means 280. Upon pivotal movement of handle 404 to the dotted line position of FIG. 26, spring 392 moves rod 362 to the left as viewed in FIG. 24 placing intermediate plate 342 in the position of FIG. 28 wherein the pins 46' are clamped or firmly retained in the pin supporting and holding means 280.

Figure 29:
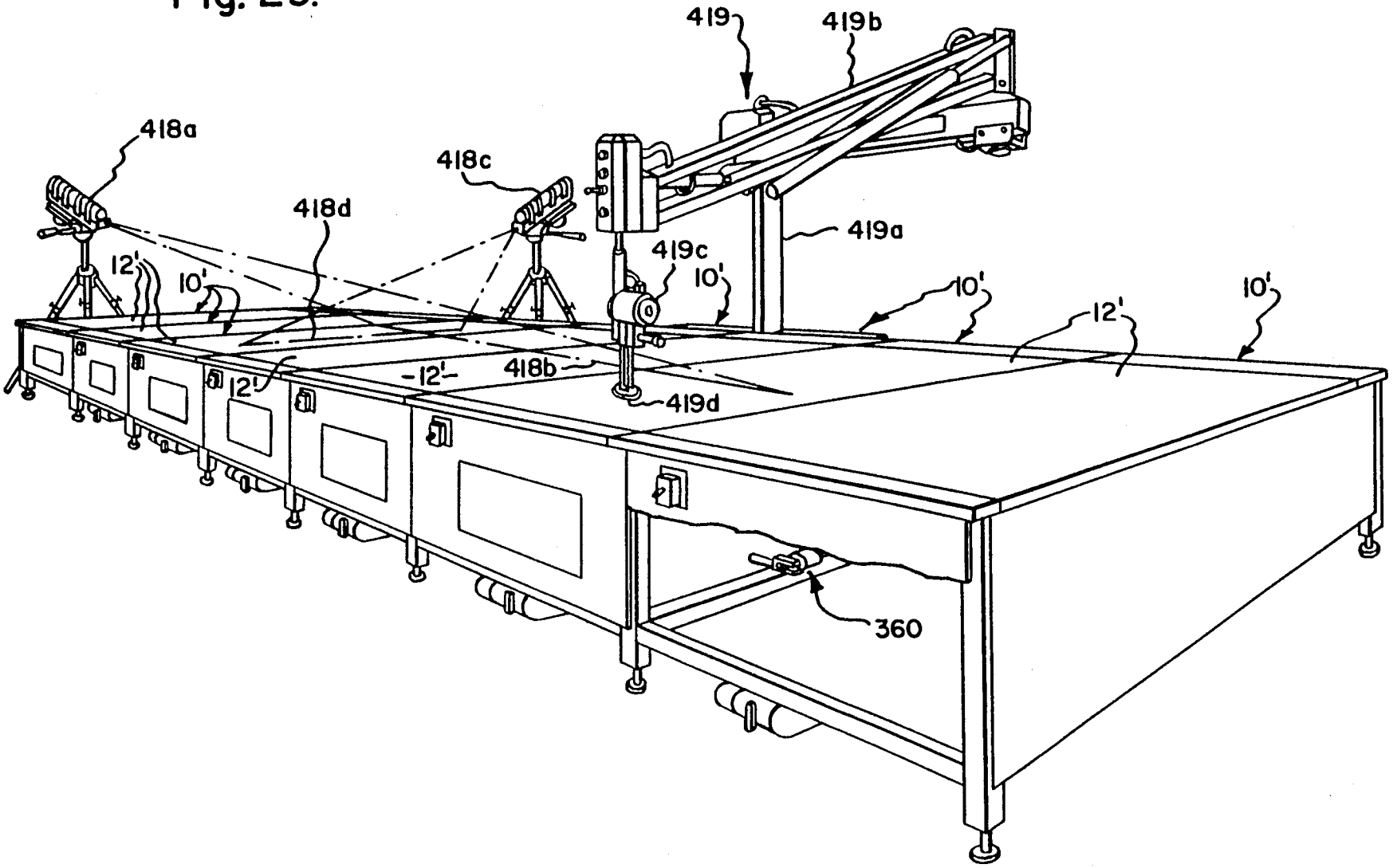
FIG. 29 is a perspective view of apparatus according to another embodiment of the present invention including laser line projectors.

FIG. 29 illustrates an arrangement of a plurality of pin table sections 10' in combination with laser line projection means according to another embodiment of the present invention. Sections 10' are joined end-to-end thereby providing the series of table tops 12' along the length of the pin table combination combination. The laser line projection means according to this embodiment is used in conjunction with the pin table to aid in aligning stripes, plaids or check materials during a pin spreading or blocking operation. The laser line projection means projects a ⅛" wide red line a maximum of distance of 14 feet along either the table length, width or both to visually highlight the match points of the fabric so fewer pins need be used to match the material. In the arrangement shown, two lasers are provided, a first laser **418*a* located at the end of the combination and projecting beam 418*b* along the length of tables 10', and the second laser 418*c* is provided on one side for projecting a line 418*d* along the width of a table section. In this arrangement, there is included a servocutter generally designated 419 including a mounting post 419*a*, a supporting frame arrangement 419*b*, and a round knife machine or cutter 419*c* which is provided with a relatively small presser foot 419*d***.

Figure 30:
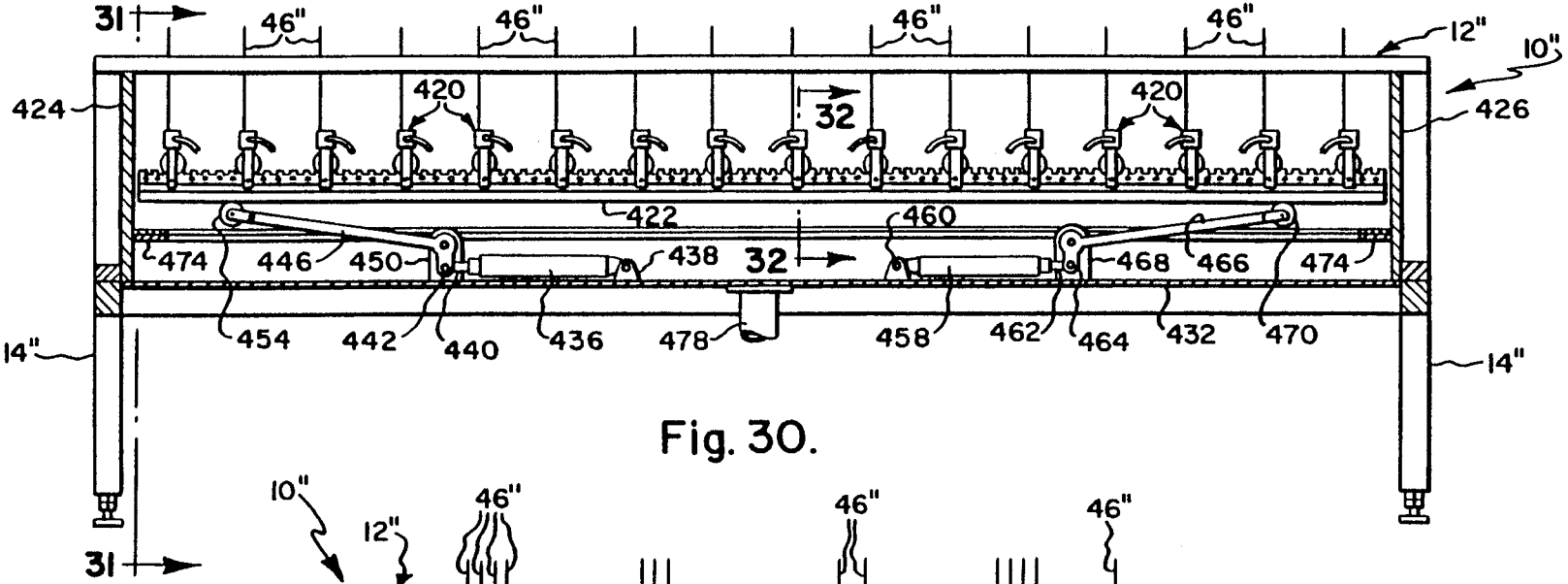
FIG. 30 is a side elevational view, partly in section, of apparatus according to another embodiment of the present invention.
Figure 31:
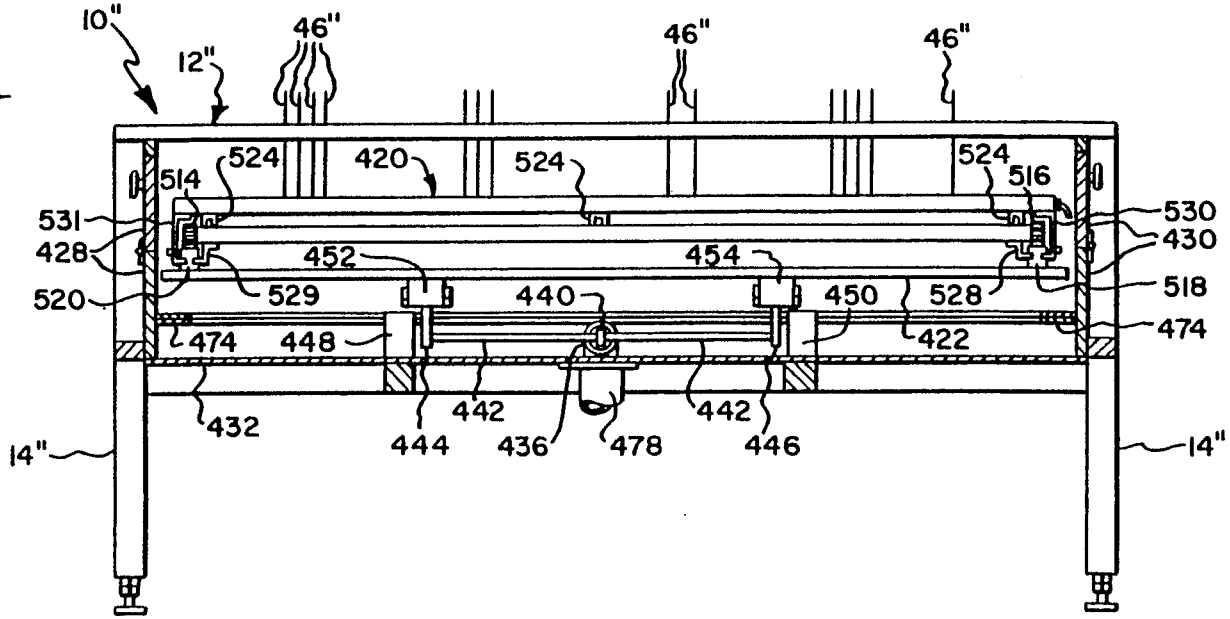
FIG. 31 is an end elevational view, partly in section, taken about on line 31—31 in FIG. 30.
Figure 33:
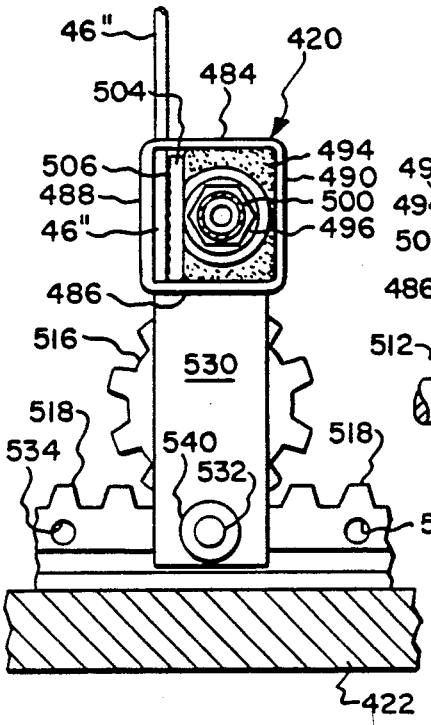
FIG. 33 is a fragmentary end elevational view taken about on lines 33—33 in FIG. 32.

FIGS. 30–35 show an alternative embodiment of the pin holding and supporting means wherein a plurality of separate pin holding and supporting means are provided in spaced relation lengthwise along each pin table section. For convenience in description, components of this embodiment similar to those of the previous embodiments are designated by the same reference number with a double prime designation. Thus, FIG. 30 shows a pin table section 10" having a top 12" and vertical supporting legs 14". There is provided a plurality of pin supporting and holding means, each designated 420, in spaced relation along the length of each table section 10". Each supporting and holding means 420, as shown in FIG. 31, extends transversely across and along substantially the entire width of table section 10". Each can hold a plurality of pins 46" in a row extending across table 10". By virtue of this arrangement, pins of adjacent rows advantageously can be closely spaced together thereby achieving a one-inch grid pattern in an effective manner which will be described.

In the illustrated arrangement, the plurality of pin supporting and holding means 420 are placed on a relatively thin rectangular supporting plate 422 having a length and width substantially equal to the length and width of table section 10". The combination of plate 422 and plurality of supporting and holding means 420 is contained within a chamber defined by tabletop 12", spaced apart end walls 424 and 426, spaced apart side walls 428, 430 and a bottom wall 432. There is provided an arrangement for raising and lowering the plurality of pin holding and supporting means 420 simultaneously together with the pins 46" carried thereby. A first hydraulic cylinder 436 is pivotally connected at the end thereof to a bracket 438 fixed to bottom wall 432. The piston rod 440 is connected through a shaft 442 disposed perpendicular to the axis of rod 440 as shown in FIG. 31 and pivotally connected at each end to the shorter arms of a pair of links 444, 446 each, in turn, pivotally connected to a pair of pivot blocks 448, 450 fixed to bottom wall 432. The other, longer arms of links 444, 446 are pivotally connected at the ends thereof to rollers 452, 454, which, in turn, contact the lower surface of supporting plate 422 in the region of end wall 424 as viewed in FIG. 30. Similarly, a second hydraulic cylinder 458 is pivotally connected at the end thereof to a bracket 460 fixed to bottom wall 432. The piston rod 462 thereof is connected through a shaft 464 disposed perpendicular to the longitudinal axis of rod 462 and pivotally connected at the ends thereof to the shorter arms of a pair of links, one of which is designated 466 in FIG. 30, and each in turn connected to a pair of pivot blocks one designated 468 fixed to bottom wall 432. The other, longer arms of the lengths are pivotally connected at the ends thereof to a pair of rollers one designated 470 contacting the lower surface of support plate 422 in the region near end wall 426.

Extension of piston rod 440 pivots links 444, 446 in a clockwise direction and extension of piston rod 462 pivots links 466 in a counterclockwise direction, which, in turn, raises plate 422 and the plurality of supporting and holding means 420 thereon which, in turn, raises pins 46" carried thereby through table top 12". Pins 46" are shown in FIG. 30 in a partially raised position. Retraction of piston rod 440 pivots links 444, 446 in a counterclockwise direction and retraction of piston rod 462 pivots links 466 in a counterclockwise direction thereby lowering plate 422, pin supporting and holding means 420 and the pins 46" carried thereby. A peripheral flange 474 extending inwardly from the side and end walls and disposed parallel to table top 12" supports plate 422 in the lowermost position. As in the previous embodiments, the raising and lowering arrangement is contained within a pressure chamber defined by table top 12", the side and end walls and bottom walls 432. A branch conduit 478 extending from a main conduit (not shown) is connected to bottom wall 432 for supplying positive and negative pressure to the interior of the chamber.

Figure 34:
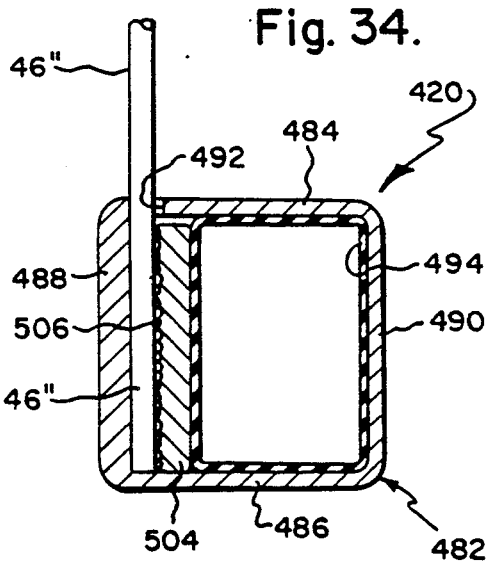
FIG. 34 is an enlarged sectional view taken about on line 34—34 in FIG. 32 and showing one position of the pin clamping means.
Figure 35:
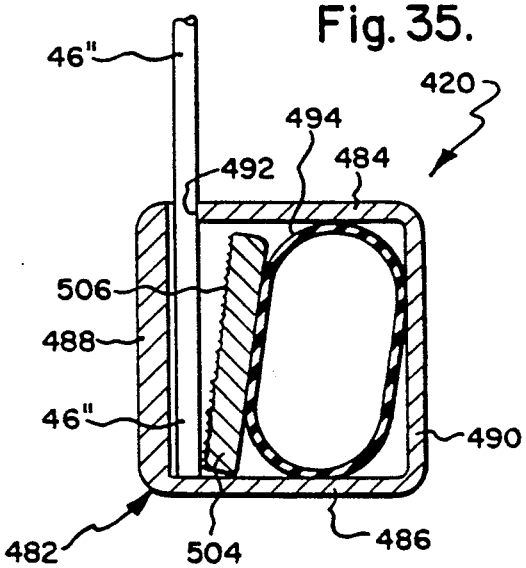
FIG. 35 is a view similar to FIG. 34 showing another position of the pin clamping means.

Each holding and supporting means 420 includes a hollow elongated housing having openings spaced along the top thereof for receiving the ends of the pins 46'' and fluid operated means within the housing having a first state wherein the pins are releasably held in supporting means 420 and a second state wherein the pins are firmly clamped in the holding and supporting means. Furthermore, each holding and supporting means 420 is movable lengthwise in opposite directions so that adjacent holding and supporting means are movable toward and away from each other to vary the distance therebetween. As shown in further detail in FIGS. 33–35, each holding and supporting means 420 includes a hollow elongated rectangular housing 482 having top and bottom walls 484 and 486, respectively, joined by spaced apart side walls 488, 490. Top wall 484 is provided with a plurality of pin receiving openings 492 in spaced relation along the length of housing 482 and adjacent one of the sidewalls, i.e. sidewall 488. Thus, the ends of pins 46'' are inserted through openings 492 and rest on the inner surface of bottom wall 486. There is provided fluid-operated means in the form of a tube or elongated bladder 494 within the housing 482 extending along the length thereof. Tube 494 is closed at one end and connected at the other through a fitting 496 to a conduit 500 leading from a source of pressurized fluid, such as compressed air. An elongated strip 504 is provided in housing 482 between tube 494 and sidewall 488 to protect the tube 494 from the ends of pins 46'', and the surface of strip 504 can be provided with serrations 506 to enhance its gripping effect on pins 466''. When fluid pressure is supplied to tube 494 it expands forcing strip 504 against pins 46'' to clamp them within housing 482 as shown in FIG. 34. When the fluid pressure is reduced or removed, the tube contracts to a position as illustrated in FIG. 35 whereupon pins 46'' are loosely held and can be removed.

Figure 32:
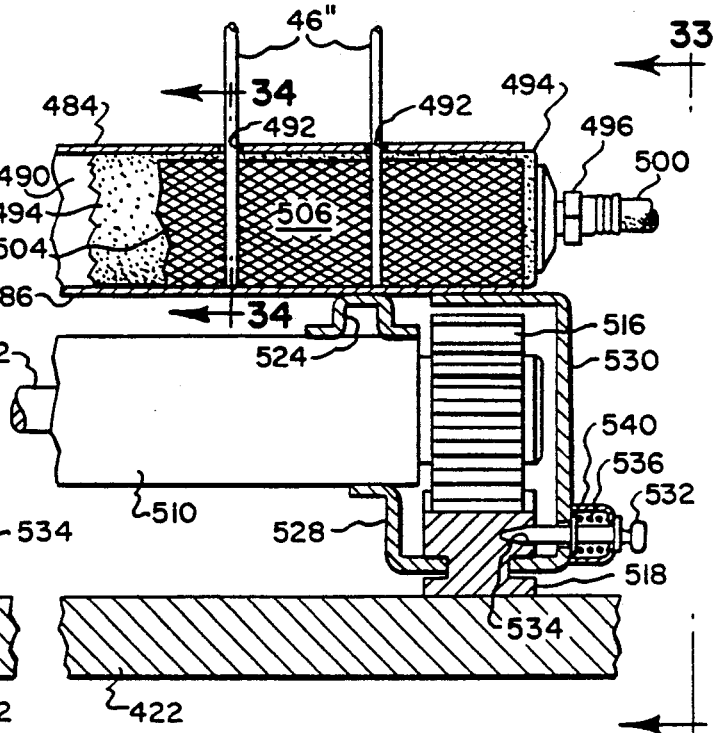
FIG. 32 is an enlarged fragmentary sectional view taken about on line 32—32 in FIG. 30.

Each housing 482 is mounted on a longitudinally movable support including an elongated tube 510 having a shaft 512 therein and a pair of pinions 514 and 516 connected on opposite ends of the shaft which mesh with a pair of racks 518 and 520, respectively, in spaced relation along opposite sides of supporting plate 422 as shown in FIGS. 30–33. Housing 482 is mounted on tube 510 by a series of brackets 524 shown in FIGS. 31 and 32. An inner, S-shaped member 528 has one leg thereof fixed to the lower surface of tube 510 at one end thereof and the other leg of member 528 is received in a longitudinal track or slot provided along the inner surface of rack 518 as shown in FIG. 32. A similar S-shaped member 529 is provided at the other end of tube 510 and engages a track in rack 520 as shown in FIG. 31. An outer, C-shaped member 530 has one flange thereof mounted to bottom 486 of housing 482 and the other flange thereof is received in an elongated slot or track defined in the outer surface of rack 518. A similar C-shaped member 531 is provided at the other end of housing 482 and engages a track in the other rack 520. There is provided means for locking the holding and supporting means at selected spaced locations along the length of table section 10''. A pin 532 fits in a selected one of a plurality of openings or recesses 534 at spaced locations along the outer surface of rack 518 and is biased by a spring 536 contained in a housing 540 carried by member 530. Thus, when the operator of the table wishes to change the spacing between adjacent ones of the holding and supporting means 420, he simply grasps pin 532 pulling it out from the opening and then moves the holding and supporting means along the racks 518 and 520 in the direction to the desired location whereupon he releases the pin 532 so that it fits in the nearest opening at that location.

Figure 36:
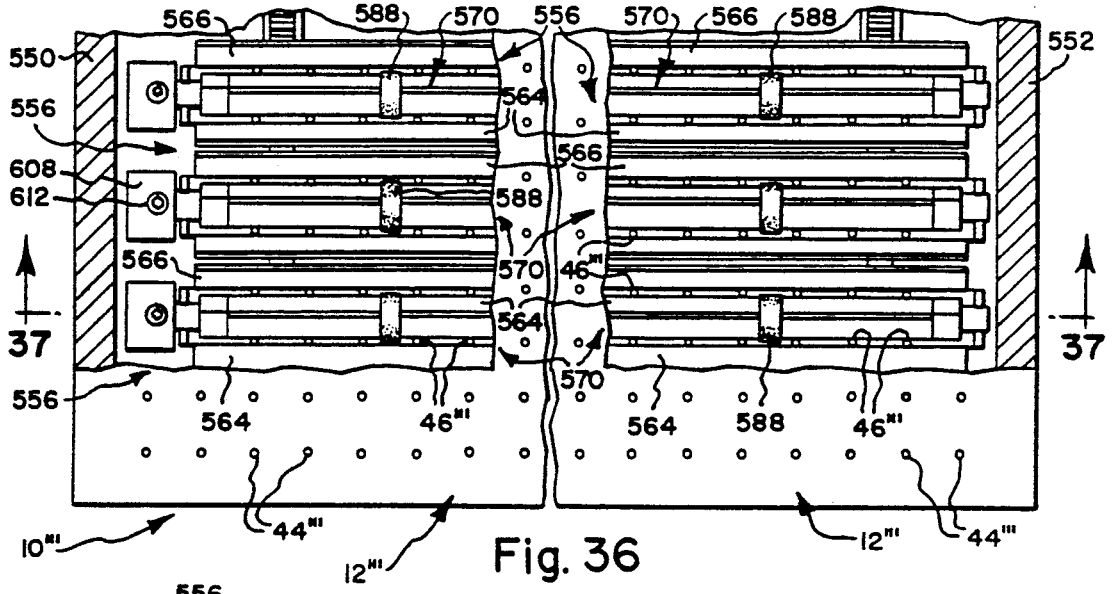
FIG. 36 is a fragmentary plan view with parts removed of apparatus according to another embodiment of the present invention.

FIGS. 36–41 illustrate a preferred embodiment of the pin table of the present invention wherein a plurality of separate pin holding and supporting means are provided in spaced relation along the length of each section of the pin table. Each pin table section is similar to that illustrated in FIGS. 30 and 31. For convenience in description, components of this embodiment which are similar to those of the previous embodiments are designated by the same reference numerals with a triple prime designation. Thus, in FIG. 36, pin table 10''' has top 12''' provided with a plurality of closely spaced apertures 44''' arranged in a grid-like pattern. Top 12''' rests on spaced apart vertical side walls 550, 552 supported by a suitable frame (not shown). There is provided a plurality of pin holding and supporting means, each designated 556, in spaced relation along the length of table 10'''. Each holding and supporting means 556, as shown in FIG. 36, extends transversely across substantially the entire width of table 10''', for holding a plurality of pins 46''' in a row extending across table 10'''. In the illustrated arrangement, each holding and supporting means 556 holds two rows of pins 46''', and the spacing between the two rows of pins in each holding and supporting means 556 is equal to the spacing between adjacent rows of pins 46''' of adjacent pin holding and supporting means 556.

By virtue of the foregoing arrangement of separate pin holding and supporting means 556, pins 46''' of adjacent rows can be closely spaced together thereby achieving a grid pattern wherein the pins are relatively closely spaced. This, in turn, optimizes matching the grid pattern of pins to plaid pattern fabrics of any size plaid. The arrangement of the present invention, wherein each individual pin holding and supporting means is of relatively narrow width, enables a one inch grid pattern to be achieved. A one inch grid pattern of pin 46''' assures that the pins 46''' will reach the match points of the plaids, and with such a pattern the plaid fabric can be moved one-half inch in either direction and the match points still will reach the pins 46'''. In the particular arrangement illustrated in FIGS. 36–41, the two rows of pins 46''' in each holding and supporting means 556 are spaced one inch apart, and each of the rows, in turn, will be spaced one inch from the adjacent row of pins 46''' on an adjacent holding and supporting means 556 when the two are in abutting relation.

As in the arrangement of FIGS. 30 and 31, the plurality of holding and supporting means 556 are supported on a rectangular plate 560 having a length and width approximately equal to the length and width of table 10''' and the assembly of the series of holding and supporting means 556 on plate 560 is contained within a chamber defined by table top 12''', sidewalls 550, 552, a pair of spaced apart end walls (not shown) and a bottom wall (not shown). An arrangement like that shown in FIGS. 30 and 31 is provided for raising and lowering the plurality of pin holding and supporting means 556 and the pins 46''' carried thereby. In other words, the rollers of the arrangement contact the lower surface of plate 560, and the rollers are raised by an hydraulic cylinder-pivoted link assembly like that of FIGS. 31 and 32.

Each holding and supporting means 556 includes an elongated housing including a pair of side walls 564, 566 which define an open top and a pin contacting means 570 between the side walls and movable between a first position wherein pins 46'' are loosely held between the contacting means 570 and corresponding one or both of the side walls 564, 566 and a second position wherein the pins 46''' are tightly held or clamped between the pin contacting means 570 and the corresponding side wall. Side walls 564, 566 have outwardly diverging ends 564*a*, 566*a* as shown in FIG. 39 to facilitate entry or insertion of pins between the side wall and pin contacting means 570.

Each pin contacting means 570 is elongated and journalled at opposite ends for pivotal movement about an axis parallel to the longitudinal axis of the holding and supporting means 556. As shown in FIG. 39, pin contacting means 570 comprises an elongated frame including a bar 574 having a length slightly less than the length of the side walls 564, 566 and disposed in a first plane and a pair of elongated strips 576, 578 in spaced parallel relation and disposed in planes perpendicular to the plane of bar 574 and which contact opposite edges of bar 574. As shown in FIG. 39, the assembly of bar 574 and strips 576, 578 has an H-shaped cross section. A pair of rods 580, 582 are fitted in corresponding open regions extending along the assembly defined by the opposite side surfaces of bar 574 and the inwardly facing surfaces of strips 576, 578. One of the rods, for example rod 580, is fixed to the assembly such as by welds 583. The other of the rods, for example rod 582, is movably held in the assembly so as to be rotatable about the longitudinal axis thereof for a purpose to be described. A plurality of bands or straps 584 shown in FIGS. 36 and 37 can be fitted around the assembly to limit the extent of movement of rods 582. The spacing between side walls 564, 566 is maintained by a pair of internal plates 585, 586 contacting the inner surfaces of side walls 564, 566 and a series of spaces 587 between the plates 585, 586 held in place by bolt and nut type fastenrs 588.

The fixed rod, i.e. rod 580, has a length greater than that of the overall assembly thereby providing extending ends 590 and 592 which are fixedly mounted in corresponding blocks 594 and 596 having recesses 594*a*, 596*a*, which are rotatably mounted in vertical support arms 598 and 600, respectively, of a frame having a base 602 which extends longitudinally along the holding and supporting means 556 and from which the arms project upwardly. Block 596 has a short shaft portion terminating in an end face adjacent the outer surface of support arm 600. Block 594 on the other hand, has a relatively long shaft portion 606 which is mounted in the body of a handle 608 having a grip 610. Handle 608 is fixed by a set screw 612 and pivoting of handle 608 moves the pin contacting means 570 between pin locking and pin releasing positions as will be described.

There is provided means for mounting the pin holding and supporting means 556 each for a limited amount of bidirectional movement along the longitudinal axis of pin table 10'''. Each pin holding and supporting means 556 includes a pair of depending end walls 620, 622 provided with aligned apertures 624 and 626, respectively, through which a shaft 630 extends so as to be rotatably mounted therein. Shaft 630 is parallel to the longitudinal axis of the pin supporting and holding means of which it is a part. The axis of shaft 630 is parallel to the axes of rods 580 and 582. First and second pinions 634 and 636, respectively, are fixed to shaft 630 adjacent opposite ends thereof and mesh with corresponding first and second racks 638 and 640, respectively, which extend parallel to the longitudinal axis of pin table 10''' and are mounted on a frame 642 supported on baseplate 560. Thus, the arrangement of shaft 630, pinions 634, 636 and racks 638, 640 allows limited movement of each pin holding and supporting means 556 in both longitudinal directions along pin table 10''' i.e. toward and away from each neighboring and adjacent pin supporting and holding means 556. Accordingly, the distance between pins of adjacent pin holding and supporting means, and thus the spacing of the grid pattern can be adjusted. The narrow width profile of each of the pin supporting and holding means 556 enables a relatively closely spaced grid pattern, i.e. as small as one inch, to be established. Furthermore, each pin holding and supporting means is releasably locked at selected spaced locations along table 10''' by an arrangement including an end member 646 which depends from base 602, the lower end of which contacts the outer surface of frame 642 and is provided with a spring-biased plunger 650 which selectively locks in spaced apertures along the length of table 10''' similar to the arrangement shown in FIG. 32.

End member 646 is provided with a central vertical slot 652 to accommodate an extension of shaft 630 which projects outwardly beyond end member 646 to receive a handle locking member 656 having a cylindrical outer wall 658 and an end wall 660. Shaft 630 is rotatably received in an aperture 664 in end wall 658 offset from the longitudinal axis of the cylinder so as to provide an eccentric mounting of member 656 on shaft 630. Member 656 is slidable on shaft 630 between axial limits established by washer 666 fixed by screw 668 to the end of shaft 630 and by the outer surface of member 646. As previously described, handle 608 is locked by the position of member 656 shown in FIGS. 37 and 38, this being enhanced by frictional engagement between grip 610 and the knurled outer surface 670 of member 656. When it is desired to move handle on the on-clamped position of the pin contacting means 570, member 656 is moved by hand inwardly of the position shown in FIG. 37 toward member 646 until it no longer contacts grip 610 whereby handle 608 moves to the unlocked position, i.e. clockwise as viewed in FIG. 38 to a vertically disposed position.

Figure 37:
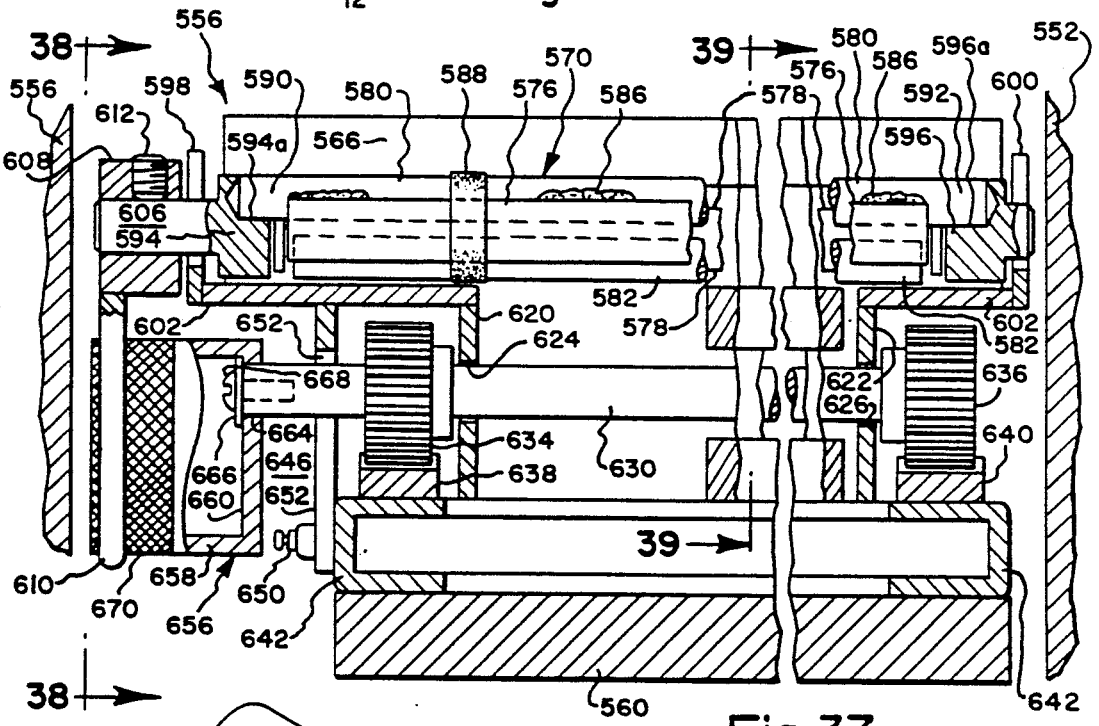
FIG. 37 is a fragmentary sectional view taken about on line 37—37 in FIG. 36.
Figure 40:
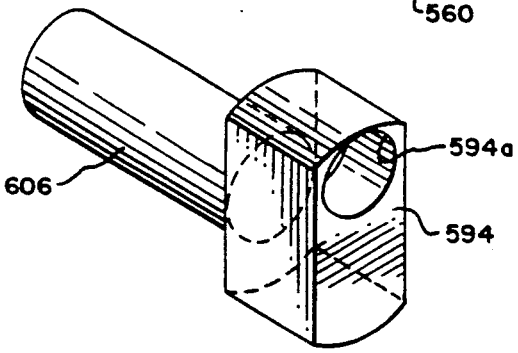
FIG. 40 is a perspective view of a component in the apparatus of FIGS. 36–39.

FIG. 42 shows an alternative embodiment of the pin contacting means of FIGS. 37 and 39. For convenience in illustration, like components are identified by like reference numerals with prime designations. In this embodiment, the pin contacting means 570' is located within a movable housing comprising a pair of elongated members 670, 672 located between pin contacting means 570' and walls 564, 566. Members 670, 672 extend longitudinally along the pin holding and supporting means 556, are found from thin metal sheet, and are movable a short distance laterally in response to movement of pin contacting means 570' to enhance the grip on the pins. As shown in FIG. 42, member 670 has a horizontal by portion 676, a vertical wall portion 678 and a diverging end 680 which, with end 566*a*, define a V-shaped trough for guiding the ends of the pins. Similarly, member 672 has a horizontal leg 686, a vertical wall portion 688 and a diverging end 690 which defines a V-shaped pin-receiving trough with end 564*a*. In the position of pin contacting means 670 shown in FIG. 42, members 670, 672 are slightly laterally movable to accommodate insertion of the pins. When pin contacting means 670 is rotated counterclockwise as viewed in FIG. 42, the ends of the pins are clamped between member wall portions 678, 688 and the corresponding walls 564, 566. Members similar to those designated 670, 672 in FIG. 42 can be employed in the embodiment of FIGS. 33–35 on opposite sides of tube 494 to enhance gripping of the pins.

Figure 43:
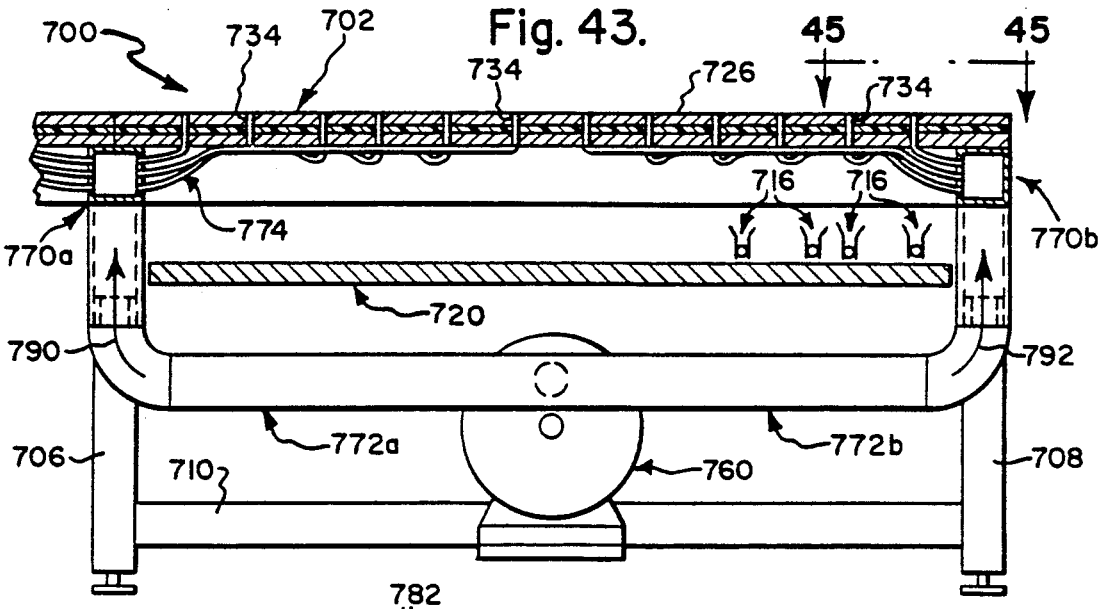
FIG. 43 is a side elevational view, partly in section and partly diagrammatic, of apparatus according to another embodiment of the present invention.
Figure 44:
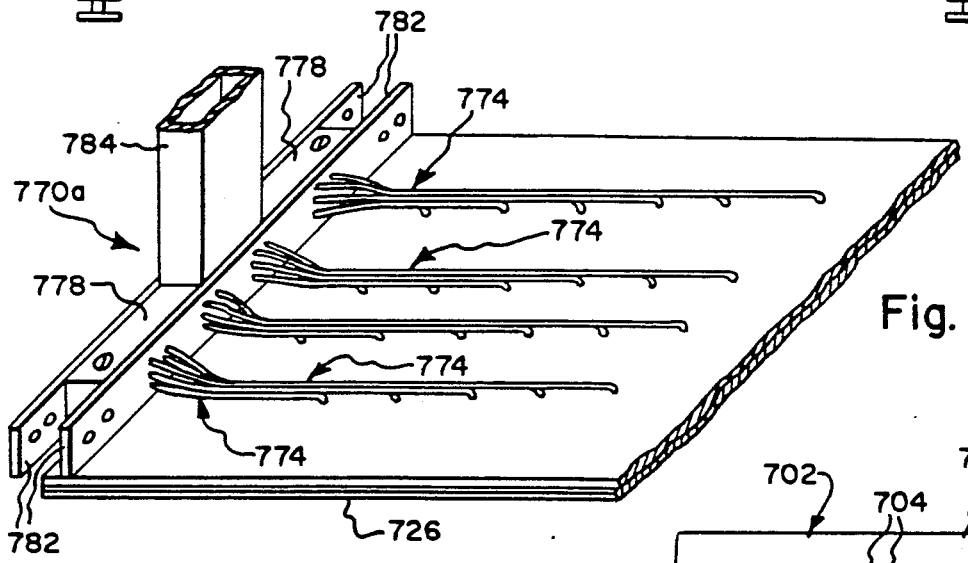
FIG. 44 is an enlarged fragmentary perspective view of a portion of the apparatus of FIG. 43.
Figure 45:
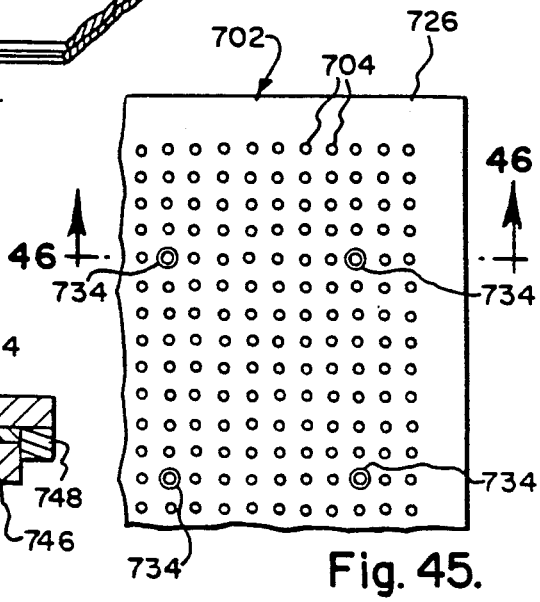
FIG. 45 is an enlarged fragmentary plan view taken about on lines 45—45 in FIG. 43.

FIGS. 43–46 illustrate an alternative embodiment of the pin table of the present invention which has the capability of applying a flotation force to sheet material on the surface thereof to facilitate movement of the material along the surface without the need for a large pressure chamber below the table surface. As shown in FIGS. 43 and 45, pin table 700 has a top 702 provided with a plurality of closely-spaced apertures 704 arranged in a grid-like pattern similar to table 10, top 12 and apertures 44 in the previous embodiments. Top 702 is supported by a plurality of vertical frame members, two of which are designated 706 and 708 in FIG. 43 which are joined by a horizontal frame member 710. There is provided a plurality of pin holding and supporting means 716 in spaced relation along the length of the table 700, each extending transversely across substantially the entire width of table 700 for holding a plurality of pins (not shown) identical to pins 48 of the previous embodiments in a row extending across table 700. Pin holding and supporting means 716 are identical in structure and function to pin holding and supporting means 556 of FIGS. 36–41 and are movable toward and away from each other in the same manner as holding and supporting means 556. As in the arrangement of FIGS. 36–41, pin holding and supporting means 716 are supported on a rectangular plate 720 having a length and width approximately equal to the length and width of table 700. Various arrangements, for example like that shown in FIGS. 30 and 31, can be employed for raising and lowering the plurality of pin holding and supporting means 716 and the pins carried thereby. As a further example, such arrangement could include a screw jack mechanism at each corner of plate 720 which jacks would be operated simultaneously by a sprocket-chain drive for raising and lowering plate 720. Each jack would comprise a vertically disposed screw threaded at the upper end to a coupling fixed to plate 720 at a corner thereof and a sprocket fixed to the lower end of the screw. A chain would be trained around each sprocket and drivenly coupled to the output of a motor carried by the frame.

Figure 46:
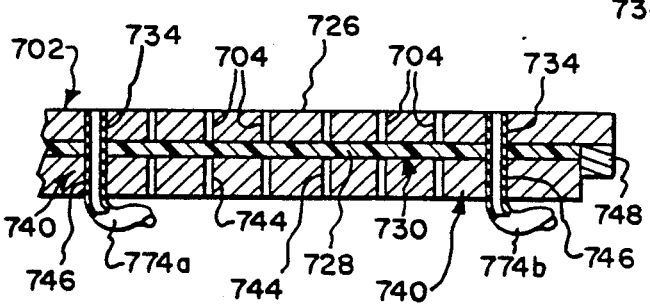
FIG. 46 is a sectional view taken about on lines 46—46 in FIG. 45.

As shown in FIGS. 43, 45 and 46 the pin table top 702 is in the form of a plate or sheet which defines a planar supporting surface adapted to receive plies of sheet material (not shown) placed thereon, and the surface has an outer portion 726 for contacting the material and an oppositely disposed portion 728. In accordance with this embodiment of the present invention, there is provided fluid sealing means 730 operatively associated with the table supporting surface for preventing fluid flow through the pin-receiving apertures 704 in a direction from the outer surface portion 726 to the oppositely disposed portion 728 while allowing the pins to extend therethrough, a plurality of openings 734 extending through the table top surface and through the sealing means 730 and at spaced locations over the surface, and means on the pin table frame for supplying positive pressure to the openings 734 to apply a flotation force to sheet material on the table top surface to facilitate movement of the sheet material along the surface. The positive pressure in openings 734 is applied to the space between outer surface portion 726 and the sheet material thereon, and sealing means 730 prevents any loss of this positive pressure through the pin-receiving apertures 704.

Sealing means 730 preferably comprises a sheet of rubber or like material extending along the oppositely disposed surface portion 728 in a manner blocking or covering apertures 704 to prevent fluid flow through the apertures. In this connection, the objective is to prevent fluid flow through apertures 704 in a direction from supporting surface portion 726 to oppositely disposed surface portion 728. Furthermore, the material of sealing means 730 allows the pins to extend therethrough, and in particular to be manually pushed therethrough by the operator with little additional effort, while at the same time maintaining its fluid sealing capability. In particular, sealing means 730 maintains a fluid seal around a pin inserted therethrough, and it re-seals the area therein from which a pin is removed. One form of material forced to perform satisfactorily for sealing means 730 is an open cell foam rubber material having a sealed outer skin and commercially available from Griswald Rubber Co., Moosup, Conn. under the designation Griswald Style #3120 blended open cell sponge, medium density, neoprene blend.

In a preferred construction of pin table 700, there is provided another sheet or plate 740 beneath and adjacent table top 702 and having a planar surface 742 which contacts sealing means 730. Plate 740 is provided with a plurality of through apertures 744 arranged in a pattern identical to that of apertures 704 in table top 702 so that each aperture 744 in plate 740 is in registry with a corresponding aperture 704 in table top 702. Thus, pins extend through apertures 704, rubber sheet 730 and apertures 744 so that the lower ends of the pins can be changed in the holding and supporting means 716 for raising and lowering the pins through the combination of table top 702, sheet 730 and plate 740. In addition, plate 740 is provided with a plurality of openings 746 arranged in a pattern identical to that of openings 734 in table top 702 and sealing means 730 so that each opening 746 in plate 740 is in registry with a corresponding opening 734. The sandwiched arrangement of table top 702, rubber sheet 30 and plate 740 provides a firm and protective mounting of sheet 730 and the peripheral edge of sheet 730 preferably is protected by a lip 748 which can be integrally formed around the periphery of table top 702 or separately attached. The arrangement is formed by first clamping table top 702 and sheet 740 together, drilling apertures 704 and 744 simultaneously and then drilling the larger diameter openings 734 and 746. The top 702 and plate 740 are their unclamped, rubber sheet 730 is placed therebetween and the arrangement is mounted together by suitable means, for example T-nut fasteners to insure good sealing. Then the openings in rubber sheet 730 are formed using a cloth drill inserted through the previously formed openings 734 and 746 in table top 702 and plate 740, respectively.

The means for supplying positive pressure to the openings 734 includes a source of positive pressure in the form of compressor/air blower 760 mounted on frame member 710 and means for connecting source 760 to the openings. In the illustrative pin table section shown in FIG. 43, source 760 is provided thereon. Alternatively, a single source or compressor/air blower could be provided for supplying positive pressure through a network of branch conduits to a plurality of pin table sections arranged in end-to-end relation.

The means for connecting positive pressure source 760 to the openings 734 includes manifold means generally designated 770 mounted on the pin table frame, means 772 for connecting the output of source 760 to manifold means 770, and conduit means 774 connected to manifold means 770 and to each of the openings 734. In the illustrative arrangement shown, a pair of manifolds 770*a*, 770*b* is provided, one at each end of pin table 700, and a pair of supply ducts or pipes 772*a* and 772*b* connect the output of compressor 760 to manifolds 770*a* and 770*b*, respectively. One of the manifolds, for example manifold 770*a*, is shown in further detail in FIG. 44 and is generally T-shaped having an elongated rectangular body 778 which extends along a major portion of the length of table top 702. The manifold body 778 is mounted to the underside of table top 702 and terminates at each end in a pair of flanges 782 for attachment to the vertical frame members. An inlet tube 784 extends from the central portion of body 778 for connection to one of the supply pipes leading from compressor 760.

The conduit means 774 comprises a plurality of tubes, preferably of flexible material, each fitted at one end into an opening in a wall of manifold body 778 and fitted at the other end into one of the openings 734. As shown in FIG. 44, the tubes 774 are arranged in groups corresponding to rows of the openings 734 and can be bundled together by appropriate ties or brackets holding the groups close to or in contact with the underside of table top 702. Similarly, the openings in the wall of manifold body 778 are arranged in corresponding groups. Tubes 774 preferably are of plastic material, preferably soft polyurethane material because of its sealing properties. The ends of two tubes 774*a* and 774*b* are shown in FIG. 46 and extend along the entire lengths of openings 734 and 746 and terminate at the outer surface of table top 702.

The arrangement illustrated in FIG. 44 occupies one-half of the table top 702, being located on the underside thereof. An identical arrangement of manifold 770*b* openings therein and tubes 774 is provided on the other-half of table top 702, being located on the underside thereof as shown in FIG. 43.

In operation, when it is desired to apply a flotation force to material on table top 702 to facilitate movement therealong, the operator manually actuates a suitable control such as a valve (not shown) to allow positive pressure fluid such as compressed air to flow from source 760 through pipes 772*a* and 772*b* and into manifolds 770*a* and 770*b* in the direction of arrows 790, 792 from which the positive pressure fluid is distributed by tubes 774 to the openings 734 and thus between the outer surface of table top 702 and sheet material placed thereon, typically in a stack. This facilitates movement of the material along the surface of table top 702 by the operator. The sealing means 730 prevents loss of the positive pressure fluid through the apertures 704. Typically, a sheet of non-permeable paper or the like is inserted between the stack and the outer surface of table top 702 to prevent loss of positive pressure fluid in an upward direction through the stack.

By way of example, in an illustrative pin table wherein top 702 is about 96 inches long by about 60 inches wide, openings 704 are arranged in a one inch grid pattern and openings 734 are arranged in an eight inch grid pattern. Table top 702 is of particle board or flake board material having a thickness of about one-half inch and is provided with an outer layer of Formica or like material defining surface portion 726. Rubber sheet 730 has a thickness of about one-quarter inch, and plate 740 also is of flake board or particle board having a thickness of about three-fourths inch. Each tube 774 has an outer diameter of about 6 mm and an inner diameter of about 4 mm. Pipes 772 are of about three inch diameter, and compressor/air blower 760 operators at 4 psi in a low pressure, high volume mode. With an impervious sheet placed between stack and table top as previously described, the apparatus has the capability of lifting cloth sheet goods in excess of 120 pounds.

It is therefore apparent that the present invention accomplishes its intended objects. In particular, there is provided a new and improved method and apparatus for supporting and matching patterned sheet material such as cloth in a stack during operations thereon such as cutting. The apparatus is in the form of a new and improved pin table which is economical in manufacture and effective and efficient in operation, and the apparatus and method result in labor and material savings and improved quality. The method and apparatus optimize matching of the grid pattern of the pins to plaid pattern fabrics of any size plaid. In addition, the apparatus and method have the capability of holding down the matched sheet material in a stack while being cut as well as the capability of moving the stacked sheet material along the supporting surface.

While embodiments of the present invention have been described in detail, that is for the purpose of illustration, not limitation.

We claim:

1. A method of supporting and shaping sheet material such as cloth comprising the steps of:

a) providing a supporting surface having a plurality of pin receiving apertures therein arranged in a grid-like pattern, fluid impervious sealing means for preventing fluid flow through said apertures and a plurality of openings extending through said surface and said sealing means;

b) placing a pattern on said surface;

c) inserting a plurality of pins each having a pointed end into said apertures and through said sealing means, said pins being in number and having an arrangement determined by said pattern;

d) maintaining said pins in said arrangement;

e) moving said pins through said apertures while maintaining said arrangement to locate the pointed ends of said pins substantially at or below said surface;

f) removing said pattern;

g) placing sheet material on said surface while moving said pins through said sheet material to maintain positioning of said sheet material on said surface;

h) placing said pattern on said sheet material in a position determined by the location of said pins;

i) shaping said sheet material according to said pattern; and j) applying positive pressure through said openings to assist movement of said material along said surface.

2. A method according to claim 1, wherein said step of placing sheet material on said surface comprises laying up a plurality of plies of sheet material on said surface to provide a stack while moving said pins through said stack to maintain alignment and matching of said plies in said stack and wherein said positive pressure is applied to said stack to assist movement of said stack.

3. Apparatus for supporting sheet material such as cloth during operations such as cutting performed thereon comprising:

a) a supporting frame;

b) means on said frame defining a planar supporting surface adapted to receive plies of sheet material placed thereon, said surface having a plurality of through apertures therein in closely spaced relation and arranged in a grid pattern on said surface, said surface having an outer portion contacting said material and an oppositely disposed portion;

c) a plurality of pins each disposed substantially perpendicular to the plane of said surface and each located in registry with one of said apertures, each of said pins having a sharp head at one end and an opposite end;

d) a plurality of separate pin holding and supporting means carried by said frame and arranged in rows therealong and facing said oppositely disposed portion of said supporting structure, said holding and supporting means releasably receiving said pins at said opposite ends thereof and maintaining the disposition of said pins substantially perpendicular to the plane of said surface and the location of said pins in registry with said apertures;

e) means carried by said frame for moving said holding and supporting means to move said pins through said apertures between a position where the heads of said pins are spaced inwardly from said outer surface portion and a position where said pins extend through said apertures and the heads of said pins are spaced outwardly from said outer surface portion so that said sheet material can be anchored on said pins;

f) each of said pin holding and supporting means being of relatively narrow width and having a length extending transversely of said supporting surface and said plurality of holding and supporting means being in closely spaced relation extending longitudinally of said supporting surface, so that pins of adjacent rows can be closely spaced together thereby achieving a grid pattern wherein the pins are closely spaced so as to optimize matching the grid pattern of the pins to fabric pattern; and g) means for mounting said pin holding and supporting means for individual movement toward and away from each other in directions longitudinally of said supporting surface for adjusting adjacent rows of pins, said mounting means comprising rack means carried by said frame and extending longitudinally of said supporting surface, a plurality of pinion means operatively engaging said rack means and rotatably carried by corresponding ones of said pin holding and supporting means, each of said pinion means having an axis of rotation disposed substantially parallel to the length of the corresponding one of said pin holding and supporting means, and releasable locking means operatively associated with each of said pin holding and supporting means for releasably locking each of said holding and supporting means individually at selected spaced locations longitudinally along said supporting surface.

4. Apparatus according to claim 3, wherein said rack means comprises a pair of racks in spaced-apart parallel relation extending lengthwise of said supporting surface, said pinion means comprises a pair of pinions rotatably carried by each of said pin holding and supporting means at spaced locations along the length thereof and meshing with corresponding ones of said racks, and said locking means includes a manually operated component located proximate one end of each of said pin holding and supporting means.

5. Apparatus according to claim 1, wherein each of said pin holding and supporting means includes pin contacting means movable between a first position wherein pins are releasably held in said pin holding and supporting means to a second position wherein said pins are firmly clamped in said pin holding and supporting means.

6. Apparatus according to claim 3, further including:

a) means on said frame for defining a pressure chamber exposed to said oppositely disposed portion of said supporting surface so that said apertures are in communication with said chamber; and b) pressure changing means operatively connected to said chamber for selectively developing either a positive or negative pressure in said chamber.

7. Apparatus according to claim 6, wherein said pressure changing means comprises means for developing a positive pressure in said chamber which is communicated through said apertures to apply a flotation force to sheet material on said surface to facilitate movement of said sheet material along said surface.

8. Apparatus according to claim 6, wherein said pressure changing means comprises means for developing a negative pressure in said chamber which is communicated through said apertures to apply a hold down force to sheet material on said surface to facilitate operating thereon.

9. Apparatus for supporting sheet material such as cloth during operations such as cutting performed thereon comprising:

a) a supporting frame;

b) means on said frame defining a planar supporting surface adapted to receive plies of sheet material placed thereon, said surface having a plurality of through apertures therein arranged in a pattern on said surface, said surface having an outer portion contacting said material and an oppositely disposed portion;

c) a plurality of pins each disposed substantially perpendicular to the plane of said surface and each located in registry with one of said apertures, each of said pins having a sharp head at one end and an opposite end;

d) a plurality of separate pin holding and supporting means carried by said frame and arranged in rows therealong and facing said oppositely disposed portion of said supporting structure, said holding and supporting means receiving said pins at said opposite ends thereof and maintaining the disposition of said pins substantially perpendicular to the plane of said surface and the location of said pins in registry with said apertures;

e) means carried by said frame for moving said holding and supporting means to move said pins through said apertures between a position where the heads of said pins are spaced inwardly from said outer surface portion and a position where said pins extend through said apertures and the heads of said pins are spaced outwardly from said outer surface portion so that said sheet material can be anchored on said pins;

f) fluid impervious sealing means operatively associated with said supporting surface for preventing fluid flow through said apertures from said outer surface portion to said oppositely disposed surface portion, said fluid sealing means allowing said pins to extend therethrough;

g) a plurality of openings extending through said surface and through said sealing means at spaced locations on said surface; and h) means on said frame for supplying positive pressure to said openings to apply a flotation force to sheet material on said surface to facilitate movement of said sheet material along said surface.

10. Apparatus for supporting sheet material such as cloth during operations such as cutting performed thereon comprising:

a) a supporting frame;

b) means on said frame defining a planar supporting surface adapted to receive plies of sheet material placed thereon, said surface having a plurality of through apertures therein arranged in a pattern on said surface, said surface having an outer portion contacting said material and on oppositely disposed portion;

c) a plurality of pins each disposed substantially perpendicular to the plane of said surface and each located in registry with one of said apertures, each of said pins having a sharp head at one end and an opposite end;

d) a plurality of separate pin holding and supporting means carried by said frame and arranged in rows therealong and facing said oppositely disposed portion of said supporting surface, each of said pin holding and supporting means being of relatively narrow width and having a length extending transversely of said supporting surface and said plurality of holding and supporting means being in closely spaced relation extending longitudinally of said supporting surface, said holding and supporting means releasably receiving said pins at said opposite ends thereof and maintaining the disposition of said pins substantially perpendicular to the plane of said surface and the location of said pins in registry with said apertures;

e) means carried by said frame for moving said holding and supporting means to move said pins through said apertures inwardly between a position where the heads of said pins are spaced inwardly from said outer surface portion and a position where said pins extend through said apertures and the heads of said pins are spaced outwardly from said outer surface portion so that said sheet material can be anchored on said pins;

f) means on said frame for defining a pressure chamber exposed to said oppositely directed portion of said supporting surface so that said apertures are in communication with said chamber;

g) pressure changing means operatively connected to said chamber for selectively developing either a positive or negative pressure in said chamber, said positive pressure being communicated through said apertures when open to apply a flotation force to sheet material on said surface to facilitate movement of said sheet material along said surface, said negative pressure being communicated through said apertures when open to apply a hold down force to sheet material on said surface to facilitate operating thereon; and h) control means operatively connected to said pressure changing means for controlling selection of positive or negative pressure developed in said chamber.

11. Apparatus according to claim 10, wherein each of said pin holding and supporting means includes pin contacting means movable between a first position wherein pins are releasably held in said pin holding and supporting means to a second position wherein said pins are firmly clamped in said pin holding and supporting means.

12. Apparatus according to claim 10, further including means for mounting said pin holding and supporting means for individual movement toward and away from each other in directions longitudinally of said supporting surface for adjusting the distance between adjacent rows of pins.

13. Apparatus according to claim 10, wherein said apertures are in closely-spaced relation on said supporting surface and arranged in a grid pattern.

14. Apparatus for supporting sheet material such as cloth during operations such as cutting performed thereon comprising:

a) a supporting frame;

b) means on said frame defining a planar supporting surface adapted to receive plies of sheet material placed thereon, said surface having a plurality of through apertures therein arranged in a pattern on said surface, said surface having an outer portion contacting said material and an oppositely disposed portion;

c) a plurality of pins each disposed substantially perpendicular to the plane of said surface and each located in registry with one of said apertures, each of said pins having a sharp head at one end and an opposite end;

d) means carried by said frame for supporting and holding said pins, said holding and supporting means receiving said pins at said opposite ends thereof and maintaining the disposition of said pins substantially perpendicular to the plane of said surface and the location of said pins in registry with said apertures;

e) means carried by said frame for moving said holding and supporting means to move said pins through said apertures between a position where the heads of said pins are spaced inwardly from said outer surface portion and a position where said pins extend through said apertures and the heads of said pins are spaced outwardly from said outer surface portion so that said sheet material can be anchored on said pins;

f) fluid impervious sealing means operatively associated with said supporting surface for preventing fluid flow through said apertures from said outer surface portion to said oppositely disposed surface portion, said fluid sealing means allowing said pins to extend therethrough;

g) a plurality of openings extending through said surface and through said sealing means at spaced locations on said surface; and h) means on said frame for supplying positive pressure to said openings to apply a flotation force to sheet material on said surface to facilitate movement of said sheet material along said surface.

15. Apparatus according to claim 14, wherein said fluid impervious sealing means comprises a sheet of rubber material extending along said oppositely disposed portion of said supporting surface in a manner covering said aperture, said rubber material having fluid sealing capability while at the same time allowing said pins to extend therethrough.

16. Apparatus according to claim 15, further including means defining an additional planar surface contacting said sealing means, said surface having a plurality of through apertures therein arranged in a pattern identical to that of said supporting surface and in registry with the apertures on said supporting surface so that said pins extend through the apertures in said supporting surface, through said sealing means and through the apertures in said additional planar surface.

17. Apparatus according to claim 16, wherein said openings also extend through said additional planar surface.

18. Apparatus according to claim 14, wherein said means for supplying positive pressure to said openings comprises:

a) a source of positive pressure; and b) means for connecting said source to each of said openings.

19. Apparatus according to claim 18, wherein said connecting means comprises:

a) manifold means mounted on said supporting rame;

b) means for connecting said source to said manifold means; and c) conduit means connected to said manifold means and to each of said openings.

20. In a method of supporting and shaping sheet material such as cloth wherein a plurality of movable pins are utilized for positioning said sheet material in relation to a pattern for shaping said material:

a) providing a supporting surface having a plurality of pin receiving apertures therein arranged in a grid-like pattern, fluid impervious sealing means for preventing fluid flow through said apertures and a plurality of openings extending through said surface and said sealing means;

b) placing sheet material on said surface so that pins located in said apertures can be moved through said sheet material to maintain positioning of said sheet material on said surface during shaping of said material; and c) applying positive pressure through said openings to said material to assist movement of said material along said surface.

21. A method according to claim 20, wherein said step of placing sheet material on said surface comprises laying up a plurality of plies of sheet material on said surface to provide a stack so that the pins can be moved through said stack to maintain alignment and matching of said plies in said stack and wherein said positive pressure is applied to said stack to assist movement of said stack.

22. Apparatus for supporting sheet material such as cloth during operations such as cutting performed thereon comprising:

a) a supporting frame;

b) means on said frame defining a planar supporting surface adapted to receive plies of sheet material placed thereon, said surface having a plurality of through apertures therein arranged in a pattern on said surface, said surface having an outer portion contacting said material and an oppositely disposed portion;

c) a plurality of pins each disposed substantially perpendicular to the plane of said surface and each located in registry with one of said apertures, each of said pins having a sharp head at one end and an opposite end;

d) a plurality of separate pin holding and supporting means carried by said frame and arranged in rows therealong and facing said oppositely disposed portion of said supporting structure, said holding and supporting means receiving said pins at said opposite ends thereof and maintaining the disposition of said pins substantially perpendicular to the plane of said surface and the location of said pins in registry with said apertures, each of said pin holding and supporting means having a length and including a pair of sidewalls in spaced relation extending along said length and having oppositely facing inner surfaces and defining a trough-like region open toward said portion of said supporting surface;

e) each of said pin holding and supporting means includes pin contacting means movable about an axis substantially parallel to said length between a first position wherein pins are releasably held in said pin holding and supporting means to a second position wherein said pins are firmly clamped in said pin holding and supporting means between said inner facing surfaces of said sidewalls and corresponding opposite surfaces of said pin contacting means; and f) means carried by said frame for moving said holding and supporting means to move said pins through said apertures between a position where the heads of said pins are spaced inwardly from said outer surface portion and a position where said pins extend through said apertures and the heads of said pins are spaced outwardly from said outer surface portion so that said sheet material can be anchored on said pins.

23. Apparatus according to claim 22, wherein said apertures are in closely-spaced relation on said supporting surface and arranged in a grid pattern.

24. Apparatus according to claim 22, wherein each of said pin holding and supporting means is of relatively narrow width and has a length extending transversely of said supporting surface and said plurality of holding and supporting means are in closely spaced relation extending longitudinally of said supporting surface, so that pins of adjacent rows can be closely spaced together thereby achieving a grid pattern wherein the pins are closely spaced so as to optimize matching the grid pattern of the pins to fabric pattern.

25. Apparatus according to claim 24, further including means for mounting said pin holding and supporting means for individual movement toward and away from each other in directions longitudinally of said supporting surface for adjusting the distance between adjacent rows of pins.

* * * * *